US010385648B2

(12) United States Patent
Wright

(10) Patent No.: US 10,385,648 B2
(45) **Date of Patent: *Aug. 20, 2019**

(54) APPARATUS AND METHOD USABLE FOR OPEN-WATER RIGLESS AND RISERLESS PLUG AND ABANDONMENT (P AND A) WORK

(71) Applicant: David C Wright, The Woodlands, TX (US)

(72) Inventor: David C Wright, The Woodlands, TX (US)

( * ) Notice: Subject to any disclaimer, the term of this patent is extended or adjusted under 35 U.S.C. 154(b) by 10 days.

This patent is subject to a terminal disclaimer.

(21) Appl. No.: 15/877,031

(22) Filed: Jan. 22, 2018

(65) Prior Publication Data

US 2018/0209239 A1 Jul. 26, 2018

Related U.S. Application Data

(63) Continuation of application No. 15/502,755, filed as application No. PCT/US2015/044518 on Aug. 10, 2015, now Pat. No. 9,874,068.

(Continued)

(51) Int. Cl.

| | |
|---|---|
| ***E21B 33/00*** | (2006.01) |
| ***E21B 33/12*** | (2006.01) |
| ***E21B 33/13*** | (2006.01) |
| ***E21B 33/14*** | (2006.01) |
| ***E21B 29/00*** | (2006.01) |

(Continued)

(52) U.S. Cl.

CPC ..... *E21B 33/12* (2013.01); *E21B 29/00* (2013.01); *E21B 29/12* (2013.01); *E21B 33/00* (2013.01); *E21B 33/064* (2013.01); *E21B 33/076* (2013.01); *E21B 33/13* (2013.01); *E21B 33/14* (2013.01)

(58) Field of Classification Search

CPC ..... E21B 33/064; E21B 33/076; E21B 33/13; E21B 29/00; E21B 29/12; E21B 33/12; E21B 33/134

See application file for complete search history.

(56) References Cited

U.S. PATENT DOCUMENTS 6,719,059 B2 * 4/2004 Dezen ..... E21B 19/002 166/368
7,585,001 B2 * 9/2009 Rose ..... F16L 37/086 285/305

(Continued)

*Primary Examiner* — Daniel P Stephenson

(57) ABSTRACT

In one system, there is an emergency pipe stroker tool, wherein the emergency pipe stroker tool is configured to act as a first mechanical barrier for a well. Further, there is an emergency quick disconnect tool in communication with the emergency pipe stroker tool, wherein the emergency quick disconnect tool comprises a connector assembly and a fluid conduit in communication with the well, and further wherein the connector assembly is configured to simultaneously detach from the well and to seal the well. Further still, there is a cement retainer in communication with the emergency quick disconnect tool and the emergency pipe stroker tool, wherein the cement retainer is configured to act as a second mechanical barrier for the well, wherein, the emergency pipe stroker tool, the emergency quick disconnect tool, and the cement retainer act in coordination to seal a well while establishing the multiple mechanical barriers.

18 Claims, 20 Drawing Sheets

Related U.S. Application Data

(60) Provisional application No. 62/035,334, filed on Aug. 8, 2014, provisional application No. 62/051,108, filed on Sep. 16, 2014, provisional application No. 62/071,814, filed on Oct. 2, 2014.

(51) Int. Cl.

| | |
|---|---|
| ***E21B 29/12*** | (2006.01) |
| ***E21B 33/064*** | (2006.01) |
| ***E21B 33/076*** | (2006.01) |

(56) References Cited

U.S. PATENT DOCUMENTS

| | | | | |
|---|---|---|---|---|
| 8,662,181 | B2 * | 3/2014 | Hamblin | E21B 33/038 166/338 |
| 9,874,068 | B2 * | 1/2018 | Wright | E21B 33/12 |
| 2006/0272818 | A1 | 12/2006 | Adam et al. | |
| 2012/0037374 | A1 * | 2/2012 | Schuurman | E21B 33/064 166/340 |
| 2012/0043089 | A1 | 2/2012 | Hoffman et al. | |
| 2013/0240207 | A1 | 9/2013 | Frazier | |
| 2013/0269948 | A1 | 10/2013 | Hoffman et al. | |
| 2014/0124686 | A1 | 5/2014 | Hallundbaek et al. | |
| 2015/0136408 | A1 * | 5/2015 | Wright | F16L 37/086 166/344 |
| 2016/0076341 | A1 * | 3/2016 | Burguieres | E21B 41/0007 166/340 |
| 2017/0044865 | A1 * | 2/2017 | Sabins | E21B 33/13 |

* cited by examiner

APPARATUS AND METHOD USABLE FOR OPEN-WATER RIGLESS AND RISERLESS PLUG AND ABANDONMENT (P AND A) WORK

CROSS REFERENCE TO RELATED APPLICATION

The present application is a continuation application claiming priority to co-pending U.S. patent application Ser. No. 15/502,755, filed on 8 Feb. 2017, which in turn claims priority to Patent Cooperation Treaty (PCT) application No. PCT/US15/44518, filed 10 Aug. 2015, which in turn claims priority to U.S. Provisional Patent Application No. 62/035,334, filed on 8 Aug. 2014 titled "System and Method Usable for Open-Water Rigless and Riserless Plug and Abandonment (P&A) Work"; U.S. Provisional Patent Application No. 62/051,108, filed on 16 Sep. 2014 titled "System and Method Usable for Open-Water Rigless and Riserless Plug and Abandonment (P&A) Work"; and U.S. Provisional Patent Application No. 62/071,814, filed on 2 Oct. 2014 titled "System and Method Usable for Open-Water Rigless and Riserless Plug and Abandonment (P&A) Work," which are all incorporated herein by this reference in their entireties.

FIELD

The present application relates generally to systems and methods usable for open-water, plug and abandonment operations within wellbores. More specifically, the systems and methods include the running of at least one cement retainer with flapper and/or check valves, the running of a subsea blow-out preventer (BOP) and emergency pipe stroker tool(s) (EPST), and the use of emergency quick disconnect (EQD) system(s) for performing the open-water, rigless and riserless, plug and abandonment operations within a wellbore.

BACKGROUND

Existing plug and abandonment systems have long needed, and now require, improvements to safety and efficiency in conducting these operations in open waters. The embodiments of the present invention provide systems and methods usable for open-water, rigless and riserless, plug and abandonment operations within a wellbore, and systems and methods usable for providing rigless operations for pulling tubulars from a wellbore or inserting tubulars into a wellbore, which provide substantial improvements to the safety and efficiency of these operations.

The present invention provides safety features and enables a secondary containment that heretofore has been greatly needed, but unseen and unknown in the art. The embodiments of the systems and methods, discussed herein, provide for multiple mechanical barriers to be placed when plugging and abandoning a well, which enhances the safety of the operations and facilitates the efficiency of the operations. In addition, the present embodiments allow for a configurable plug and abandonment system that can be customized for a specific application, or a specific range of applications, wherein such configurability can allow for meeting present and future local and international standards and regulatory requirements.

A need exists for open-water, rigless and riserless, plug and abandonment operations that can be efficiently operated within a wellbore. A need exists for safer and more efficient plug and abandonment operations, which can translate to a safer operating environment for personnel, an avoidance of costly failures in regards to the plug and abandonment operations, and/or the avoidance of unnecessary cost for needless equipment and/or procedures, in a variety of settings, including industrial, commercial, and the like.

A need exists for plug and abandonment operations that can be customized for a specific application, or a specific range of applications, to meet present and future local and international standards and regulatory requirements in an efficient manner.

The present application meets these needs.

SUMMARY

The present application relates to systems and methods usable for open-water, rigless and riserless plug and abandonment operations within wellbores. In an embodiment, a system includes an emergency pipe stroker tool, which is configured to act as a first mechanical barrier for a well. An emergency quick disconnect tool is in communication with the emergency pipe stroker tool, and the emergency quick disconnect tool comprises a connector assembly and a fluid conduit in communication with the well, wherein the connector assembly is configured to simultaneously detach from the well and to seal the well. In an embodiment, the system can include a cement retainer that is in communication with the emergency quick disconnect tool and the emergency pipe stroker tool, wherein the cement retainer can comprise at least one flapper valve, at least one check valve, or combinations thereof and can be configured to act as a second mechanical barrier for the well, and wherein the emergency pipe stroker tool, the emergency quick disconnect tool, and the cement retainer can all act in coordination to seal the well, while establishing the multiple mechanical barriers.

An embodiment of the present invention includes a system for sealing a well with multiple mechanical barriers. The system comprises an emergency pipe stroker tool that is configured to act as a first mechanical barrier for the well, an emergency quick disconnect tool that is in communication with the emergency pipe stroker tool, and a cement retainer in communication with the emergency quick disconnect tool and the emergency pipe stroker tool, wherein the cement retainer is configured to act as a second mechanical barrier for the well, and wherein, the emergency pipe stroker tool, the emergency quick disconnect tool, and the cement retainer can act in concert to seal the well with the first mechanical barrier and the second mechanical barrier. The emergency quick disconnect tool can comprise a connector assembly and a fluid conduit in communication with the well, wherein the connector assembly can be configured to simultaneously detach from the well and seal the well.

In an embodiment, one or more funnel guides can be used to orient the emergency pipe stroker tool, the emergency quick disconnect tool, the cement retainer, or combinations thereof, with respect to the well.

In an embodiment, the emergency pipe stroker tool can comprise a gripping mechanism, such as a spider, wherein the gripping mechanism can be configured to clamp or grip a tubular for inserting the tubular into a well or removing the tubular from the well, or for holding a string of tubulars, such as a work string of tubulars. The emergency pipe stroker tool can comprise an actuator for disconnecting a tubular from the well, and the actuator can comprise at least one hydraulic cylinder, at least one motor, or combinations thereof.

In an embodiment, the emergency pipe stroker tool can include at least one hydraulic cylinder for movement and stroking of the emergency pipe stroker tool. Hydraulic fluid for operation of the hydraulic cylinder can be provided by at least one accumulator located on the emergency pipe stroker tool, wherein the at least one accumulator can provide a pressure storage reservoir containing pressurized fluids, gases, or combinations thereof.

The emergency pipe stroker tool can be configured for communication with a blow-out preventer, including at least one annular blowout preventer, at least one ram blowout preventer, or combinations thereof. In an embodiment, the emergency pipe stroker tool is in communication with at least one annular blowout preventer that is in communication with the well, and the annular blowout preventer can be usable for monitoring, controlling and sealing the well.

In an embodiment, the emergency pipe stroker tool is configured to connect to an emergency quick disconnect tool and to cause the emergency quick disconnect tool to at least partially detach from the well. In an embodiment, the emergency pipe stroker tool is configured to automatically actuate the emergency quick disconnect tool in an emergency situation to seal the well, in series or simultaneously. Such an emergency situation can comprise a platform drive off, a ship drive off, a loss of communication with a platform, a loss of communication with a ship, or combinations thereof.

Embodiments of the emergency pipe stroker tool comprise a connector assembly that includes at least two connector components and/or at least one valve for sealing a fluid conduit in communication with the well.

The emergency pipe stroker tool can comprise a stinger, which can be lowered into the wellbore by use of coiled tubing. In an embodiment and after the pump pressure is used to open the flapper valves, the stinger can be used to push open the cement retainer for lowering the emergency pipe stroker tool into the well.

In an embodiment, the emergency pipe stroker tool may comprise a cement retainer that includes at least one valve or combinations of valves (e.g., flapper valve, check valve) that can be configured to act as a second mechanical barrier and to seal the well. The cement retainer can include a perforating gun, which can be usable to form one or more perforations in the casing of the wellbore or a lining of the wellbore, and into the formation in the surrounding area and proximate to the wellbore. After forming the perforations, a cement can be squeezed and deposited into the one or more perforations and deposited on the cement retainer to act as a final plug, whereby the wellbore and the surrounding area are sealed for completing the plug and abandonment operations.

Embodiments of the present invention include methods for sealing a well with multiple mechanical barriers. In an embodiment, the steps of the method include providing a blowout preventer system with an emergency pipe stroker tool for insertion into the well, and attaching a perforating gun to a cement retainer for running the cement retainer and the perforating gun into the well. In an embodiment, the cement retainer comprises at least one flapper valve, at least one check valve, or combinations thereof. In this embodiment, the emergency pipe stroker tool is configured to act as a first mechanical barrier for well control operations, and the cement retainer, comprising at least one flapper valve, at least one check valve, or combinations thereof, is configured to act as a second mechanical barrier for well control operations.

The steps of the methods can continue by inserting a work string of tubulars with a stinger into the well and forming an opening in the cement retainer, which can comprise the at least one flapper valve, the at least one check valve, or combinations thereof, by the use of the stinger. The steps can continue by attaching the blowout preventer system within the well and inserting the emergency pipe stroker tool into the opening in the cement retainer, wherein the emergency pipe stroker tool is in an extended position, and wherein the emergency pipe stroker tool is in mechanical communication with the blowout preventer and the cement retainer at the opening to provide the first mechanical barrier.

In an embodiment of the method, a gripping mechanism is used for gripping at least one tubular of the work string of tubulars, for holding the work string of tubulars within the well.

The steps of the method for sealing a well with multiple mechanical barriers can further include attaching an emergency quick disconnect tool to the well, wherein the emergency quick disconnect tool is in mechanical communication with the emergency pipe stroker tool, and closing at least one blowout preventer of the blowout preventer system. The method steps can continue by lowering the emergency pipe stroker tool further into the well, and within the cement retainer, and, then, firing the perforating gun to create a plurality of perforations into a surrounding formation that is proximate to the well. The steps of the method can conclude with the depositing of a material into the plurality of perforations for sealing the well with the use of multiple mechanical barriers.

In an embodiment, the methods for sealing a well with multiple mechanical barriers can include pressurizing the cement retainer, comprising at least one flapper valve, at least one check valve, or combinations thereof, prior to firing the perforating gun for creating the plurality of perforations through a casing or a lining of the well, and into the surrounding formation proximate to the well. The methods can further include squeezing cement into the plurality of perforations and the surrounding formation proximate to the well. In an embodiment, the method can further include releasing the gripping mechanism for removing the work string of tubulars from the well. Then, the steps of the method can include actuating the emergency pipe stroker tool and the emergency quick disconnect tool to seal the well with multiple mechanical barriers and shearing any tubing attached to the well.

In an embodiment, the methods for sealing a well with multiple mechanical barriers can include the step of orienting the emergency pipe stroker tool, the emergency quick disconnect tool, the cement retainer, or combinations thereof, with respect to the well by using at least one funnel guide. The funnel guide can be used to connect the cement retainer to another cement retainer, the cement retainer to at least one valve that can include the at least one flapper valve and/or the at least one check valve, or combinations thereof. In an embodiment, the combination of the cement retainer and the at least one flapper valve, the at least one check valve, or combinations thereof, can form the second mechanical barrier for well control operations.

BRIEF DESCRIPTION OF THE DRAWINGS

The detailed description will be better understood in conjunction with the accompanying drawings as follows.

In the detailed description of various embodiments usable within the scope of the present disclosure, presented below, reference is made to the accompanying drawings, in which.

DETAILED DESCRIPTION OF THE EMBODIMENTS

Figure 1A:
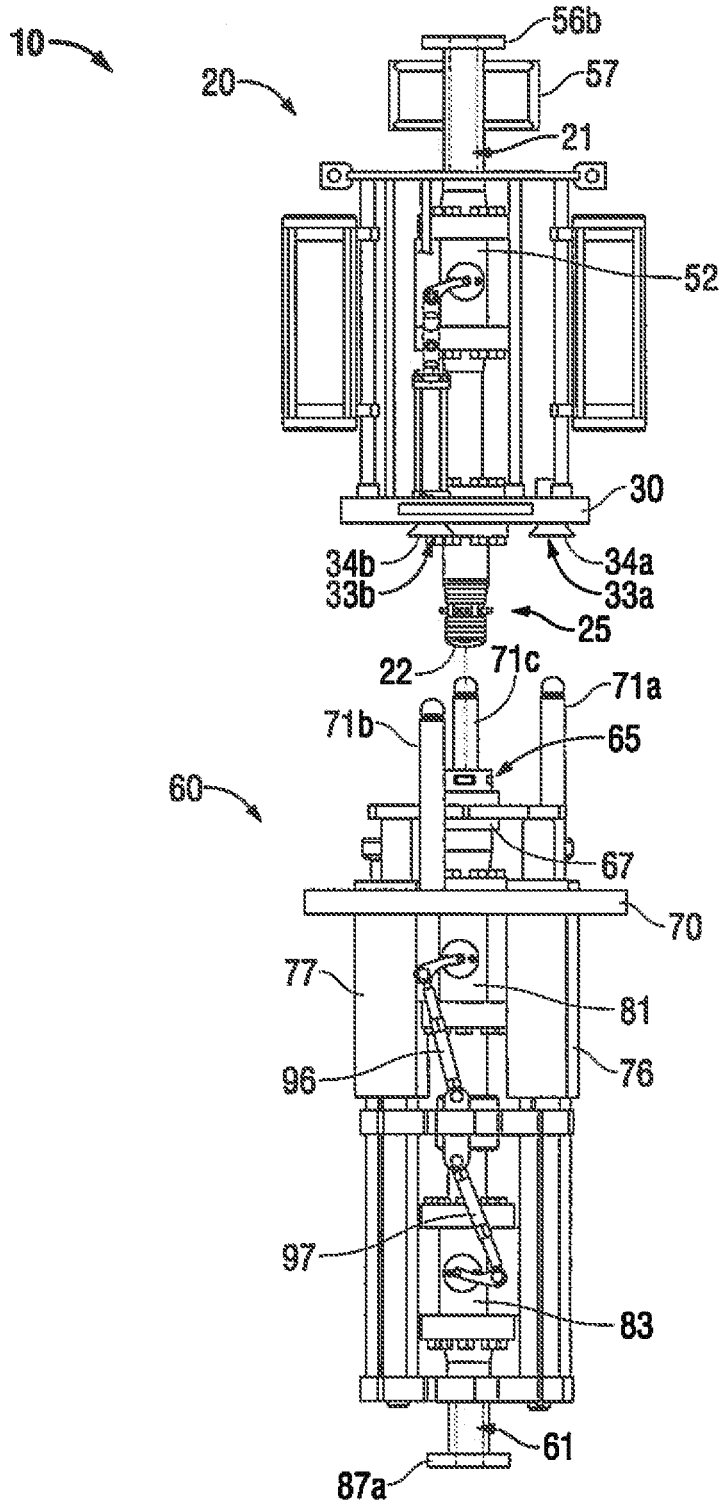
FIGS. 1A and 1B depict side views of an embodiment of a connector apparatus (10) usable within the scope of the present disclosure.

Before explaining the present apparatus and methods in detail, it is to be understood that the apparatus and methods are not limited to the particular exemplary embodiments and that it can be practiced or carried out in various ways. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Specific structural and functional details disclosed herein are not to be interpreted as limiting, but merely as a basis of the claims and as a representative basis for teaching persons having ordinary skill in the art to variously employ the present invention. Specific narrative examples are provided to aid in the understanding of the present invention, but are not intended to implicate functional or usage limitations.

Terminology used within this application is intended to have the meaning within well operations as known to persons having ordinary skill in the art. Descriptive terms for well operations and/or other similar operations will be readily recognized by persons having ordinary skill in the art, in addition to equivalent operations being readily apparent.

The terms flapper, check valve, ball valve, valve, and the like are used interchangeably to refer to any device used to regulate flow of matter through a conduit. Such flows may be fluids, such as gasses or liquids, solids, such as mud, or any combination thereof.

The term fluid is generally used for liquids or gasses, but also encompasses slurries, suspensions, high viscosity materials that may be considered solids, and the like.

The terms for commonly used equipment such as blowout preventers, remotely operated vehicle, multi service vehicle, stab, seal, perforating gun, and the like are used to refer to the multiple variants of these structures as well as equivalent items or methods used in the art to perform the intended functions of the named devices.

Structures such as base plates, guide rods, or other support elements have been shown and discussed having traditional shapes and configurations, but can be of any profile or contour that accomplishes the desired functions.

The term spring is used herein to generally refer to a biasing means for a component. Actuators for various mechanical assemblies or components are similarly described herein. Any equivalent biasing or actuation means known to persons having ordinary skill in the art can be substituted for such structures.

Similarly the terms tubing, pipe, and conduit are used interchangeably throughout the application. The term latch refers to any means known to persons having ordinary skill in the art for securing components together, either removably or permanently as the situation warrants.

The present embodiments relate to methods and systems capable of use in open-water, rigless, and riserless plug and abandonment (P&A) work environments, such as those located subsea. In general, the disclosed systems and methods may be used when the wellbore is sufficiently plugged, e.g., all or some of the plugs are in place, and sufficiently devoid of tubing, e.g., the tubing has been cut and pulled from the wellbore. In other situations, the present systems and methods can be used to seal an operating well and shear the attached tubing.

The embodiments of the disclosed methods and systems include the use of remotely operated vehicles (ROVs), multi-service vehicles (MSVs), and/or remotely actuated connectors for making or breaking connections during the (dis)assembly of subsea plug and abandonment operations equipment and/or other well operation equipment, wherein such connections, whether direct or indirect, are between or among the well operation equipment, including, for example, but without limitation, single or multiple blowout preventer ("BOP"), an emergency pipe stroker tool ("EPST"), an emergency quick disconnect ("EQD"), and combinations thereof. Further, and with reference to the drawings, the methods and systems may include rigging up a cement retainer. The cement retainer may include one or more flapper and/or check valves, e.g., ball valves, and may be used to isolate the area, and form an additional mechanical barrier, where the casing or lining of the wellbore will be perforated by a perforating assembly having one or more perforating gun(s) therebelow.

The present invention provides safety features and secondary containment means that are heretofore unseen and unknown in the art. The system and method discussed herein allow for multiple mechanical barriers to be placed when plugging and abandoning a well. Furthermore, the present embodiments provide configurable plug and abandonment systems and methods of use that can be customized for a specific application or a specific range of applications. Such configurability can allow for meeting present and future local and international standards and regulatory requirements.

To proceed with abandonment of the well, the cement retainer and perforating assembly may be lowered into the wellbore and set above the plug(s), e.g., a bridge plug or cement plug. In performing this step, the methods and systems include rigging up a cement retainer for running into the wellbore. In an embodiment, the methods and systems can include rigging up a funnel guide that can be used to connect one cement retainer to another cement retainer and/or flapper/check valves, for running into the wellbore. In an alternative embodiment, the methods and systems may include running the cement retainer into the wellbore without the flapper/check valves.

The methods and systems may further include picking up the work string with stinger and flapper prongs/probes, and running the work string into the water, up to the last joint of pipe. The methods and system may further include installing, and optionally, testing, a cross-over flange with a coil tubing, e.g., 2-inched coiled tubing, EQD system, such as the one described in co-pending U.S. patent application Ser. No. 14/152,750, filed on Jan. 10, 2014 and U.S. patent application Ser. No. 14/083,754, filed on Nov. 19, 2013, wherein the entireties of these pending patent applications are hereby incorporated, by this reference, for further enabling an emergency quick disconnect (EQD) and this disclosure's methods and systems as a whole.

Joints of pipe can be connected to form a tubular string, which can be used in drilling and for conducting other well operations. Oil and gas equipment, such as spiders comprising slips, can be used to hold the individual pipe for connecting the joints of pipe together to ultimately form the tubular string. In an embodiment of the present invention, the emergency pipe stroker tool (EPST) can comprise a spider for gripping and/or holding pipe or other tubulars. In an extended position, the EPST may be attached or run into the wellbore, followed by the rigging up and running into the wellbore of the cement retainer. The running of the cement retainer can include the use of the spider, wherein the slips of the spider may be set to grip and hold the pipe (e.g., tubulars or a string of tubulars) for conducting well abandonment operations.

By utilizing an EPST, the present invention is distinguished from the state of the art as known to persons having ordinary skill in the art. The EPST in conjunction with a BOP forms a mechanical barrier that is absent from currently used systems. This further allows for the shearing of pipe in emergency situations, such as a platform drive off, a ship drive off, a loss off communications with a plat form or a ship, or combinations thereof and the like.

The EPST can work in conjunction with the emergency quick disconnect tool to shear coiled tubing and to seal the well by closing valves within the EQD tool. Furthermore, one or more valves (e.g., a flapper valve, a check valve, or combinations thereof) can be incorporated into the cement retainer in order to add yet another mechanical barrier to the system. In this manner, multiple safety mechanisms can be instituted into currently utilized procedures for plugging and abandonment of a well. The use of the several mechanical barriers add layers of safeguards that were heretofore not present in the art.

Figure 8:
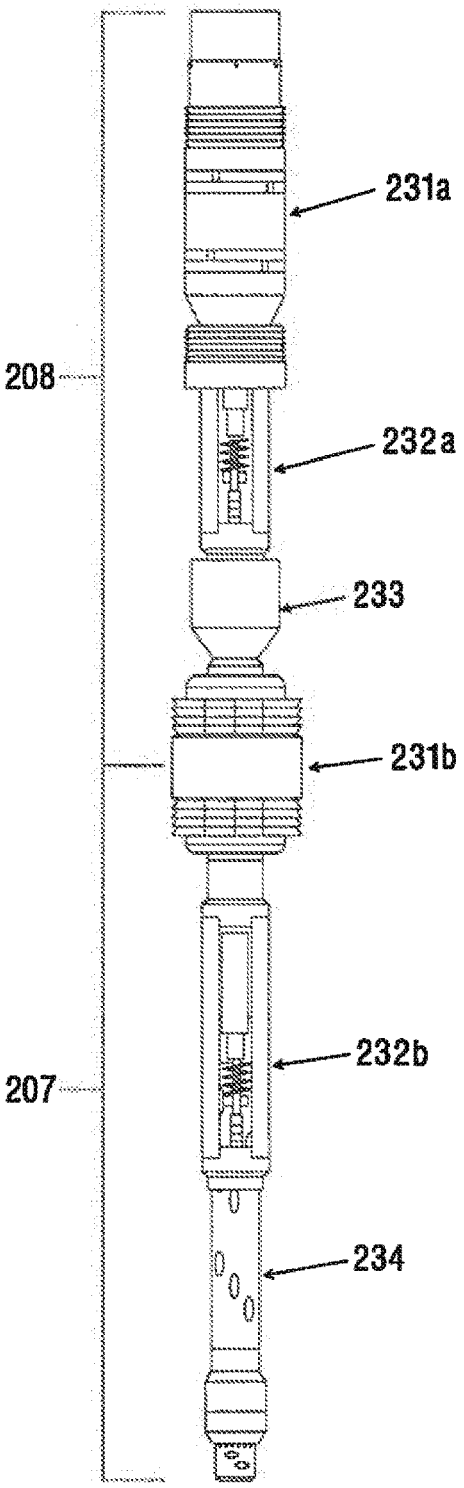
FIG. 8 depicts a general arrangement of an embodiment of a cement retainer, flapper/check valves, and perforating gun, which is usable within the scope of the present disclosure.

The methods and system can include picking up, latching, and optionally testing all connections of the EQDs, which can be dual coiled tubing EQD(s). Thereafter, the methods and systems can continue by closing the annular BOP and pipe ram(s). Then, the EPST may be lowered into the wellbore and may be stung into the cement retainer, for example, the upper portion as shown in FIG. 8. In an embodiment, a stinger can be lowered into the wellbore, by use of coiled tubing, and after pump pressure is used to open the flapper valves, the stinger can be used to push open the cement retainer for the lowering of the EPST.

The methods and systems may continue by pressuring up the cement retainer and firing the perforating gun(s). The perforating assembly is used to form perforations through the casing or lining wall and into the formation therearound. After perforating, a material, such as cement, can be squeezed and/or deposited into the perforations. After the cement is squeezed into the perforations, the run-in or work string may be disconnected from the cement retainer, and cement may be deposited on the cement retainer to act as a final plug, and, thereby, seal the wellbore and surrounding area.

The disclosed methods and systems provide several advantages over the prior state of the art. One advantage is that running the cement retainer with flapper and/or check valves provides at least two mechanical barriers for well control operations. Additionally and alternatively, running a subsea BOP with the EPST provides another barrier, and may allow pipe shearing if desired. Thus the preceding advantages collectively evince methods and systems providing at least two or three mechanical barriers for well control operations. Yet another advantage is that use of the EPST with the coil EQD provides greater safety and protection with regard to well operations, such as in the case of a drive-off or if a ship goes black, as the EPST will close the EQD and disconnect the coil tubing. Furthermore, the work string may be lifted out of the cement retainer(s), and the flapper(s) may be used to close the wellbore off from one or more sources of leak(s).

Figure 1B:
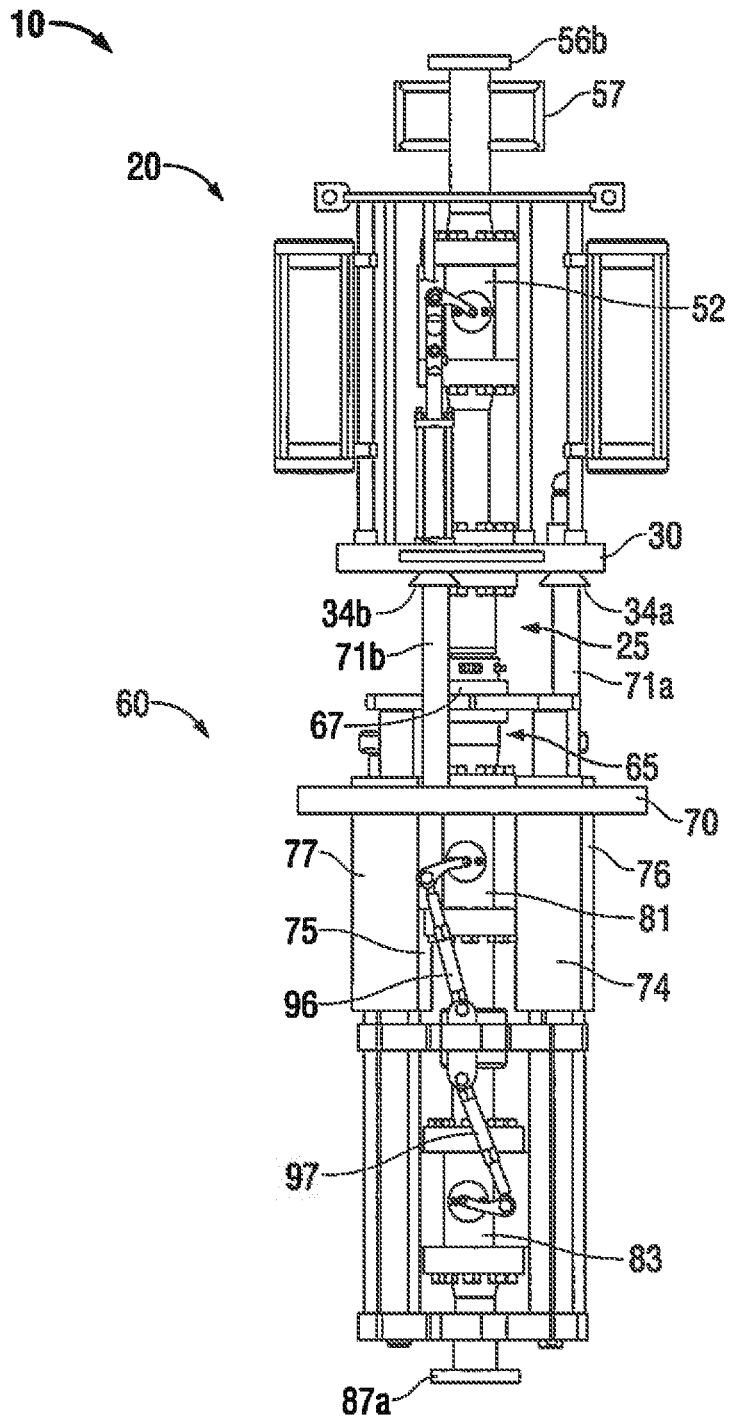

Before turning to other aspects of the disclosed methods and systems, further disclosure regarding the EQD ensues. Referring now to FIGS. 1A and 1B, depicting side views of an embodiment of a modular connector apparatus (10) usable within the scope of the present disclosure. The depicted modular connector apparatus includes a male connector (20) and a female connector (60), each having a bore (21, 61) extending therethrough, such that, when the male stab (25) of the male connector (20) and female receptacle (65) of the female connector (60) are engaged, a continuous passageway is formed, allowing flow of a fluid (e.g., pressurized hydraulic fluids, stimulation fluids, chemicals, wellbore fluids, water) through the connector apparatus (10). For example, a source of fluid, such as a fluid conduit (not shown), can be connected to the upper flange (56*b*) of the male connector (20), while a second fluid conduit or an item of subsea equipment (not shown), for example a tree running tool or subsea tree, can be connected to the lower flange (87*a*) of the female connector (60), and the modular connector apparatus (10) can allow fluid communication therebetween when the male and female connectors (20, 60) engage, as shown in FIG. 1B. Specific elements of the depicted male and female connectors are shown in greater detail in the remaining FIGS. and described below.

Figure 2A:
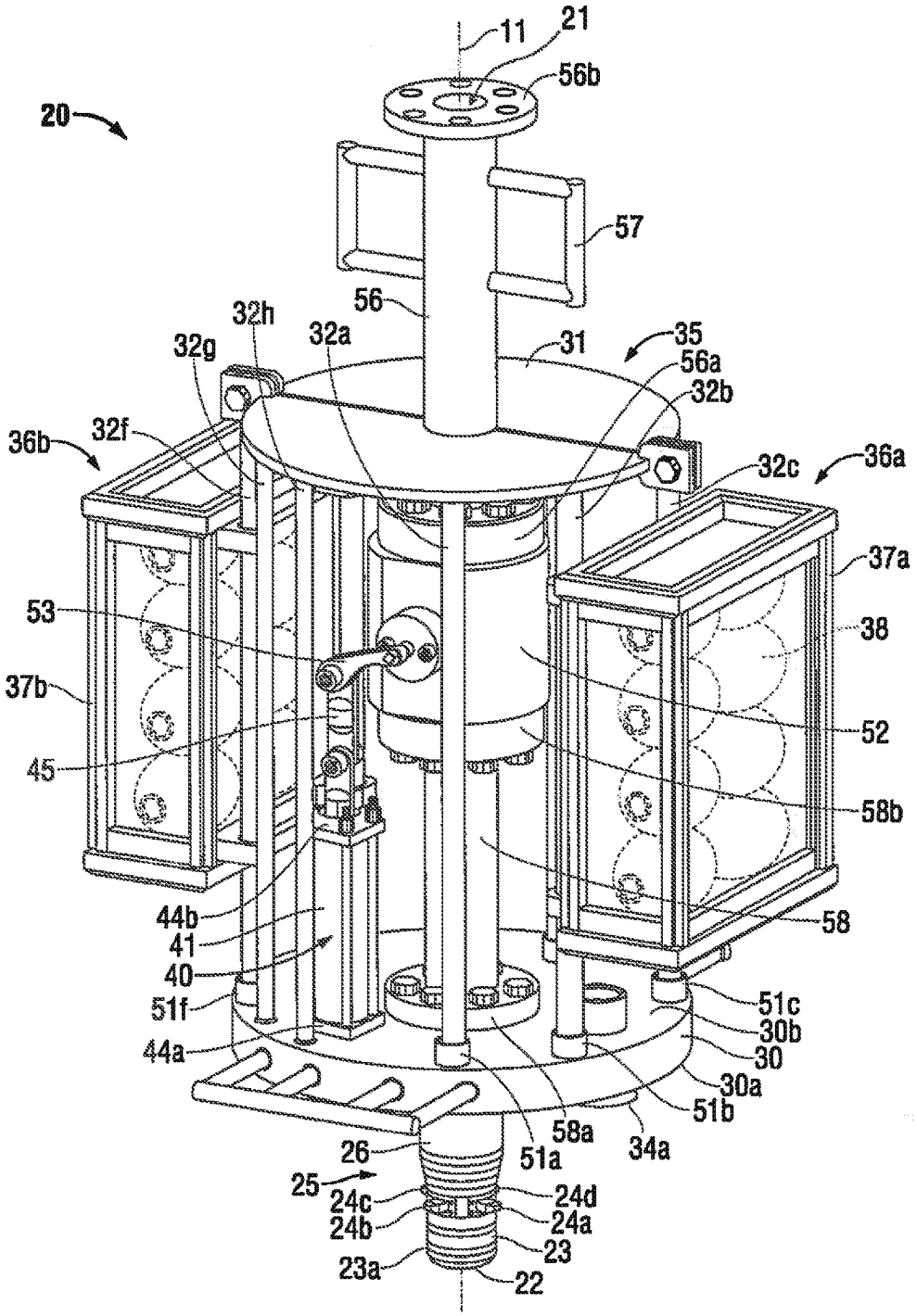
FIGS. 2A and 2B depict an isometric view and a cross-sectional view of an embodiment of a male connector that is usable within the scope of the present disclosure.
Figure 4:
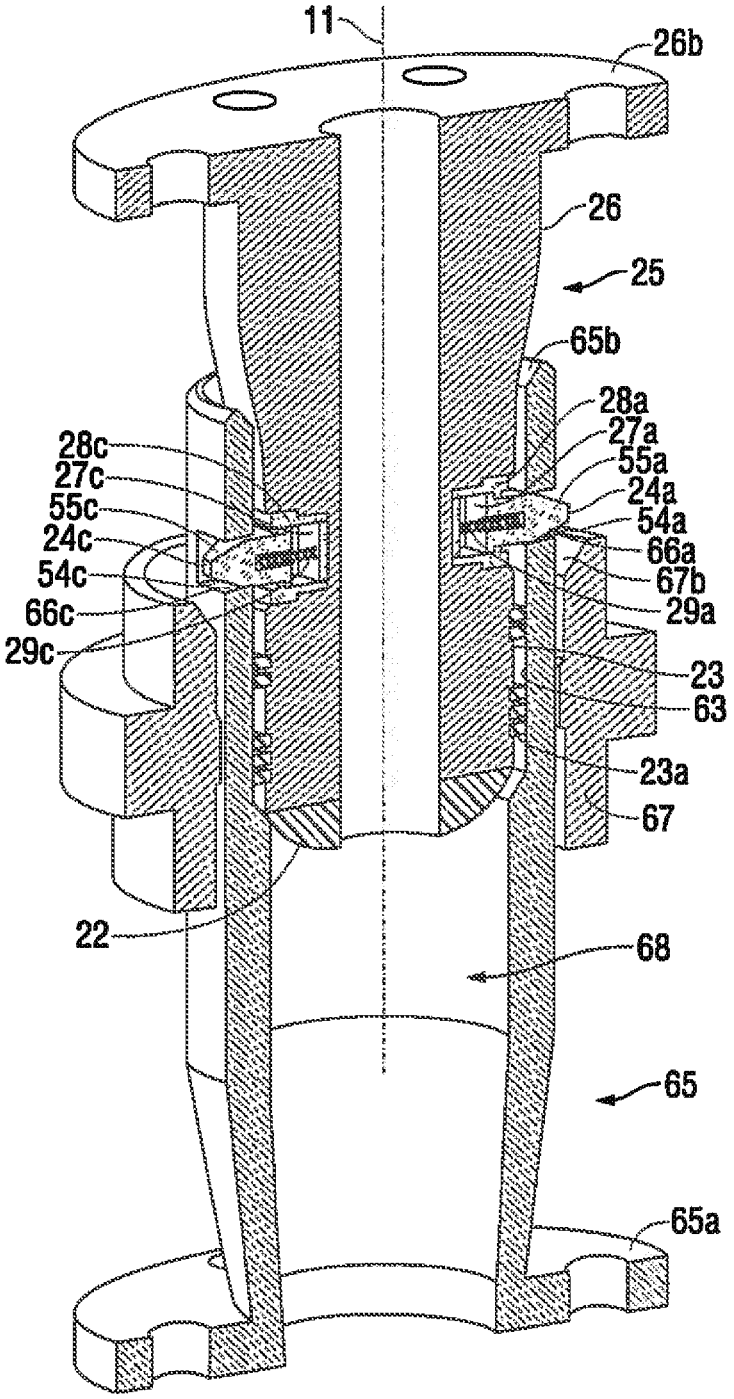
FIG. 4 depicts a close-up cross sectional view of an embodiment of a female connector comprising a cylindrical receptacle, which usable within the scope of the present disclosure.
Figure 9:
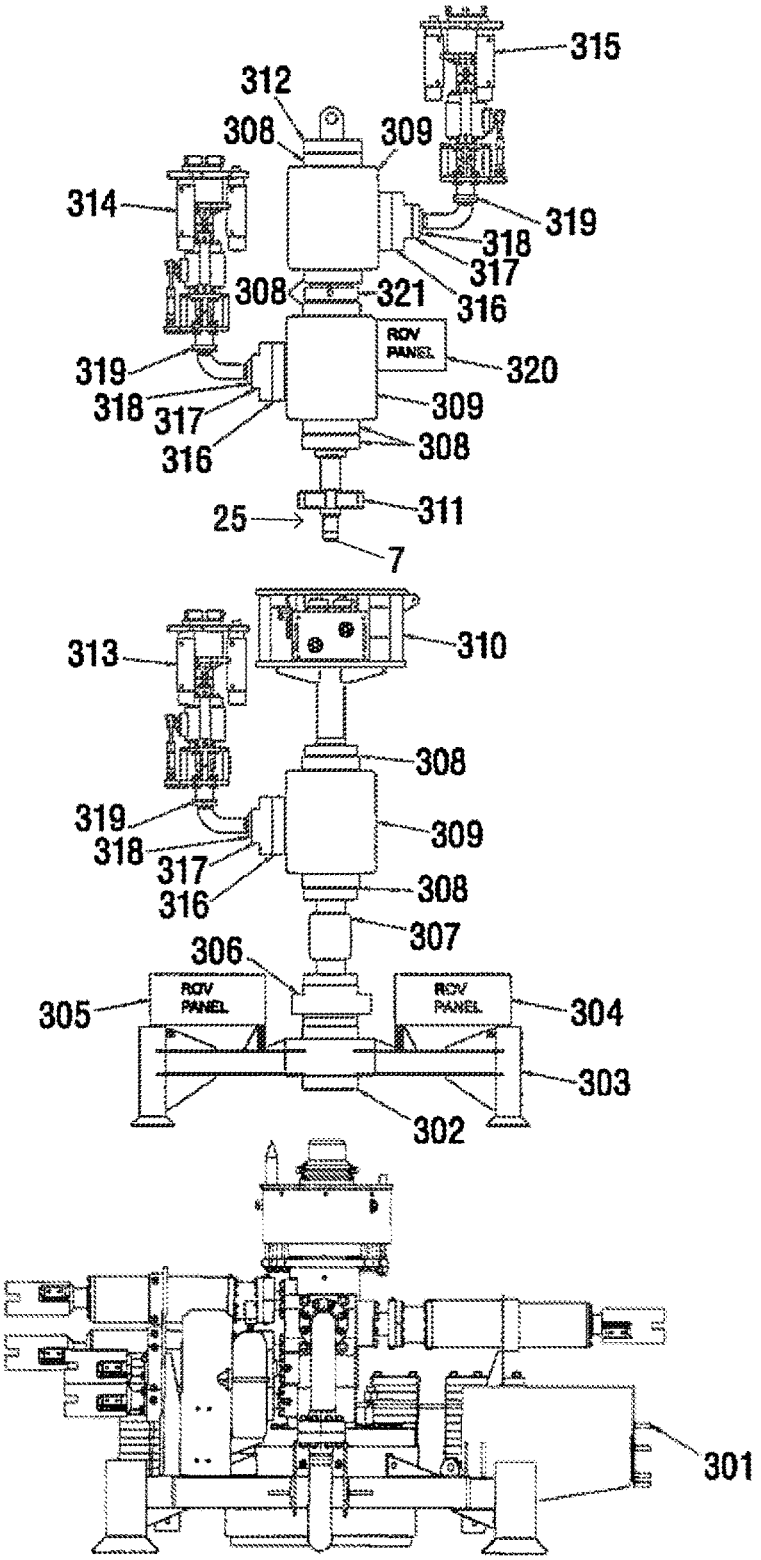
FIG. 9 depicts a general arrangement of an embodiment of a modular connector, triple BOP and EQD systems, usable within the scope of the present disclosure.

As an alternative embodiment to that shown in FIGS. 1A, 1B and 2A, FIG. 9 depicts a modular connector apparatus, in which the male connector (311) includes a male stab (25) that does not comprise latches (24*a-d*, as shown in FIG. 2A) or a housing (28*a*, 28*c*, as shown in FIG. 4) therefor. Stated otherwise, the male stab (25), as shown in FIG. 9, does not include a locking mechanism embedded within the connector body(ies), such as "dogs." Instead, the male connector (311) and the female connector (310) interface, are connected through, one or more seals (7) (e.g., o-rings (7)), therefor. Although these are two non-limiting examples of mating, it is understood that alternative, secure, mating mechanisms, including other sealing and/or locking mechanisms for connecting the male connector (20, 311) and a female connector (60, 310), may be used. Discussion below, however, continues with specific relation to the alternative, example embodiment having locking mechanisms or latches (24*a-d*) and a latching housing (28*a*, 28*c*), only, for purposes of illustration; that is, the discussion could have continued just as easily with o-ring(s) (7) or other sealing mechanisms.

Figure 2B:
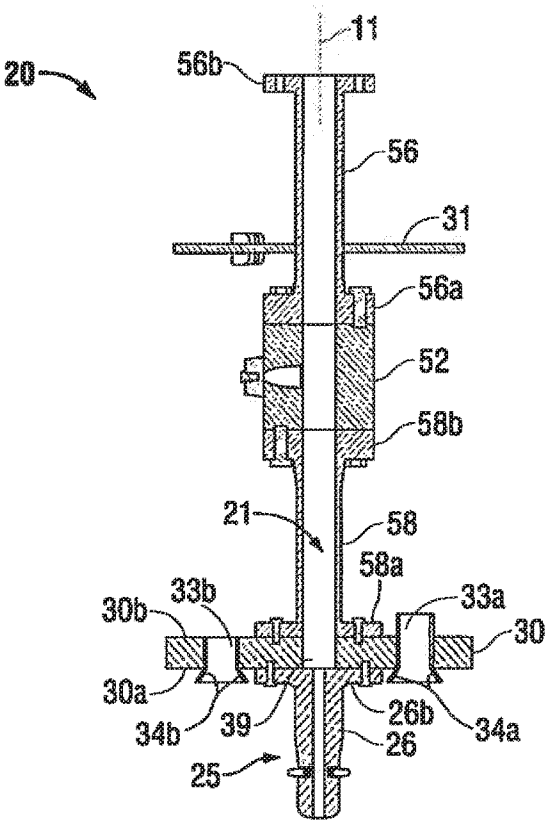

Referring now to FIGS. 2A and 2B, an isometric view of an embodiment of the male connector (20), usable within the scope of the present disclosure, is shown. The male connector (20) is shown having a fluid passageway (21) (e.g., an axial bore) along the longitudinal axis (11) thereof and spanning the length of the male connector (20). As further depicted, the fluid passageway (21) extends the longitudinal length of the male connector (20), and through individual components forming the male connector (20). Specifically, the fluid passageway is defined by an upper extension (56), a ball valve (52), a lower extension (58), a base plate (30), and a stab section (25).

Referring again to FIG. 2A, the lower end of the male connector (20) comprises the stab section (25), which is adapted to lock with the female receptacle section (65, see FIG. 1A) of the female connector (60, see FIG. 1A). The embodiment of the male connector (20) depicts the stab section (25) comprising a generally cylindrical main body (26), four latches (24*a-d*), a sealing area (23), and a nose cone (22). In the course of engagement, the rounded nose cone (22) aids the insertion of the stab section (25) into the receptacle (60), through contact between the nose cone (22) and the internal surface of the receptacle (65). To prevent or reduce damage to the receptacle (65) upon insertion, the nose cone (22) can be constructed from a material that is softer than that the receptacle (65), including delrin or other plastics, bronze or other soft metals, or any other rigid material that is softer than the receptacle (65).

Referring again to FIG. 2A and to FIG. 4, which depicts a close-up cross sectional view of an embodiment of the stab (25) and the receptacle (65), the external sealing area (23) of the male connector (25) forms a fluid seal against the internal sealing surface (63) of the receptacle (65). The sealing area (23) comprises a generally cylindrical configuration adapted for entry into the receptacle (65), resulting in engagement between the seal rings (23*a*) and the sealing surface (63). The depicted seal rings (23*a*) prevent fluids from breaching the connection between the stab (25) and the receptacle (65), when the sealing area (23) is engaged with a corresponding sealing surface (63). It should be understood that in alternate embodiments, the manner of creating a fluid seal can include any type, configuration, number, and/or combination of sealing elements, including elastomeric seals, O-rings, gaskets, metal or elastomeric rings, cup seals, metal-to-metal seals, and/or other types of sealing elements. The sealing members may also include one or more bidirectional or unidirectional sealing elements (not shown), such as cup seals, oriented in opposite directions. Such seal configurations can prevent fluid from breaching the seals during operations involving positive or above ambient internal fluid pressures. The described seal configurations can also prevent fluids from breaching the seals during operations involving vacuum pressures, or when communicating fluids at pressures that are below ambient fluid pressures.

As further depicted in FIGS. 2A and 4, the stab section (25) is shown comprising four protrusions, called latches (24*a-d*), extending radially outward from their respective cavities (27*a-d*, 27*b* & 27*d* not shown) extending into the stab body (26) adjacent to the sealing region (23). Specifically, FIG. 4 shows the latches (24*a*, 24*c*) being positioned within a latch housing (28*a*, 28*c*), and the lathes being extended therefrom by springs (29*a*, 29*c*) located within the latch housing (28*a*, 28*c*). As described below, in the course of the stab (25) connection and disconnection procedures, the latches (24*a*, 24*c*) can be retracted into respective cavities (27*a*, 27*c*), by pushing the latches (24*a*, 24*c*) inward with sufficient force to compress the springs (29*a*, 29*c*). It should be understood that while the present embodiment comprises four latches (24*a-d*) spaced equidistantly (i.e., 90 degrees apart) about the body (26) of the stab section (25), alternate embodiments (not shown), usable within the scope of the present disclosure, can include any number of latches spaced about the body (26) at any desired distances.

As further depicted in FIG. 4, the latches (24*a-d*, 24*b* and 24*d* not shown) comprise front sloped surfaces (54*a-d*, 54*b* and 54*d* not shown) and back sloped surfaces (55*a-d*, 55*b* and 55*d* not shown), which are shown oriented diagonally with respect to the longitudinal axis (11) and located on opposite sides of the latches (24*a-d*, 24*b* and 24*d* not shown). During connector (10) engagement procedures, the sloped surfaces (36*a-d*) can be used to transfer direction of a force, wherein lateral forces directed at the front and back sloped surfaces (54*a-d*, 55*a-d*, 54*b* and 54*d* not shown, 55*b* and 55*d* not shown) can be directed to compress the latches (24*a-d*), forcing them to retract into their respective cavities (27*a-d*, 27*b* and 27*d* not shown). Specifically, during stab connection operations, the latches (24*a-d*) can be retracted through lateral contact between the upper edge of the receptacle (65) and the front sloped surfaces (54*a-d*) of the latches (24*a-d*) and, during stab disconnection operations, between the upper edge of the sleeve (67) and the front sloped surfaces (54*a-d*, 54*b* and 54*d* not shown). As depicted in FIGS. 2B and 4, the upper end of the stab body (26)

terminates with a flange (26*b*), which is connected to the lower face (30*a*) of a base plate (30).

Referring again to FIGS. 2A and 2B, the Figures depict the base plate (30) as a generally flat circular plate having a heavy-duty construction, which can be adapted to withstand large bending forces and to support additional components, such as the cage assembly (35) and the spring apparatus (40). The base plate (30) further comprises a central aperture (39) at its approximate center to define a portion of the fluid passageway (21). The depicted embodiment also includes three guide rod apertures (33*a-c*, 33*c* not shown) located around the central aperture (39) and extending through the base plate (30), between the upper and lower surfaces (36*b*, 36*a*). The depicted base plate (30) further comprises three conical guides (34*a-c*, 34*c* not shown) (e.g., pipe segments), shown in FIG. 2B, each positioned within a respective guide rod aperture (33*a-c*). The conical guides (34*a-c*, 34*c* not shown) comprise interior angled surfaces which contact the guide rods (71*a-c*, see FIG. 3A) of the female connector (60, see FIG. 3A) during engagement, as described below. The conical guides (34*a-c*, 34*c* not shown) capture the guide rods (71*a-c*) as the male connector (20) descends into the locking position with the female connector (60).

As further depicted in FIGS. 2A and 2B, the upper face (30*b*) of the base plate (30) connects with a lower flange (58*a*) of the lower extension pipe (58), wherein the upper flange (58*b*) of the lower extension pipe (58) is connected to a ball valve (52) usable to selectively shut off fluid flow through the fluid passageway (21) of the male connector (20). The ball valve (52) comprises a lever (53) usable to actuate the ball valve (52) between open and closed positions. Although FIGS. 2A and 2B depict a ball valve (52), it should be understood that in alternate embodiments (not shown) of the male connector (20), other flow control valves known in the industry, such as butterfly valves, gate valves, globe valves, or any other valves, may be used. As shown, the upper side (i.e., the opposite side) of the ball valve (52) is connected to the lower flange (56*a*) of the upper extension pipe (56), which can also comprise an upper flange (56*b*) adapted to form a fluid connection with an external fluid conduit (not shown). Although FIGS. 2A and 2B depict the upper and lower extension pipes (56, 58) comprising flange connections (56*a*, 56*b*, 58*a*, 58*b*), in alternate embodiments of the male connector (20) the extension pipes (56, 58) may comprise other connection types known in the industry, including male and/or female threads (not shown).

Figure 5:
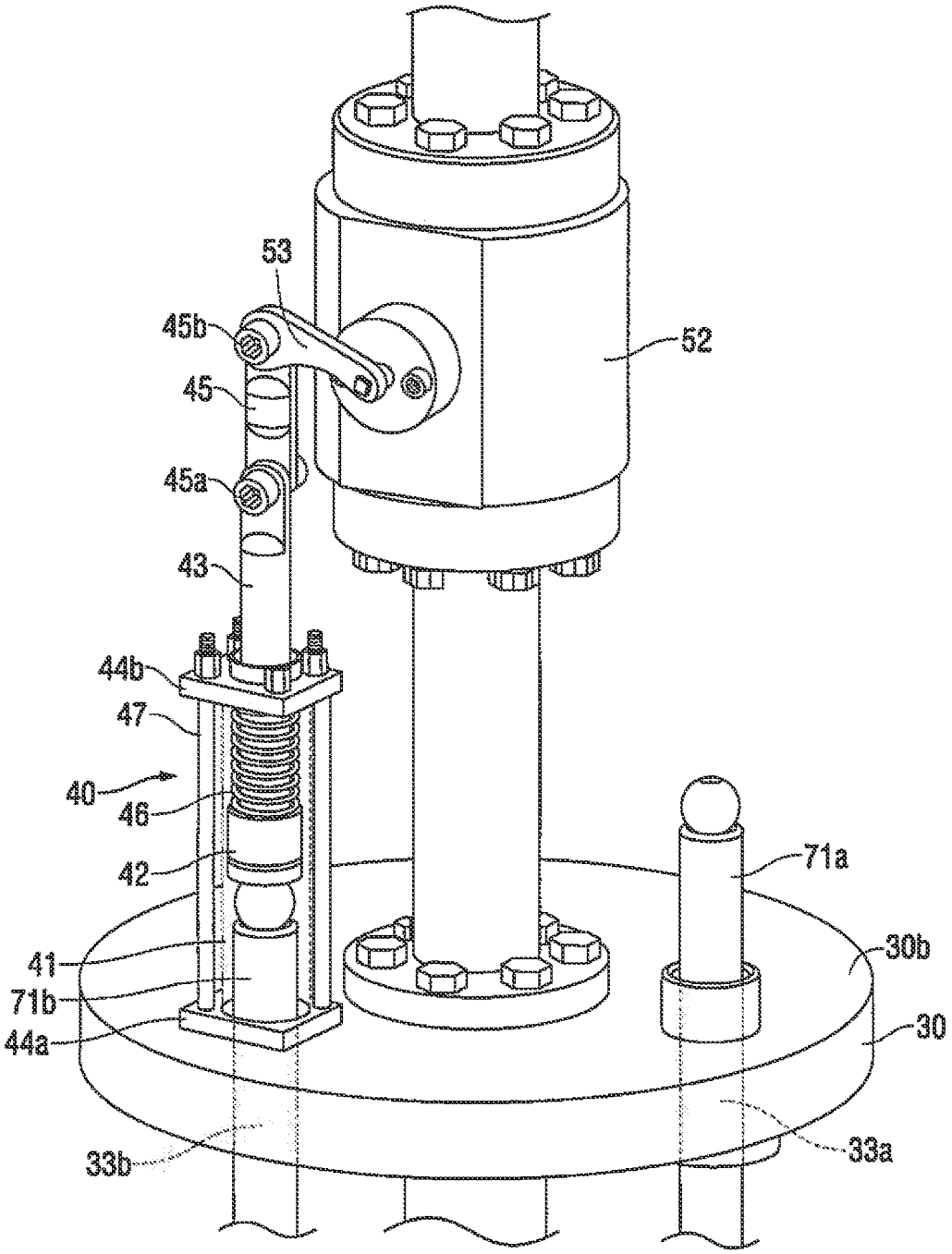
FIG. 5 depicts an isometric view of the male connector comprising a spring apparatus that is usable to actuate a ball valve between open and closed positions, which is usable within the scope of the present disclosure.

The male connector (20), as depicted in FIGS. 2A and 5, comprises a spring apparatus (40) usable to actuate the ball valve (52) between open and closed positions. The depicted spring apparatus (40) comprises a tube (41) encompassing a piston (42), slidably positioned therein, wherein the piston (42) can be connected to a rod (43), which extends through an upper end cap (44*b*). The rod (43) can be connected to the ball valve lever (53) by an extension link (45), wherein the upper and lower ends of the extension link (45) forms pivotal connections between the lever (53) and the rod (43). As depicted in FIG. 5, the pivotal connections are formed by an upper bolt (45*b*), extending through the lever (53) and the upper end of the extension link (45), and by a lower bolt (45*a*), extending through the upper end of the rod (43) and the lower end of the extension link (45). As further depicted in FIG. 5, the piston (42) is biased in the retracted (i.e., downward) position by an internal spring (46) positioned within the tube (41) (shown as an outline for clarity) about the rod (43). The spring (46) extends between the upper end cap (44*b*) and the piston (42), forcing the piston (42) in the downward direction toward the lower end cap (44*a*). The lower end cap (44*a*) comprises a vertical hole extending therethrough and retains the piston (42) within the tube (41) against the force of the spring (46). In FIGS. 2A and 5 the spring apparatus (40) is shown biasing the ball valve (52) to a normally closed position. Specifically, the spring (46) maintains (i.e., forces) the piston (42) in a downward position, thereby forcing the rod (43) and the extension link (45) to pull the ball valve lever (53) to closed valve position.

FIGS. 2A and 5 depict the spring apparatus (40) being held together and connected to the upper face (30*b*) of the base plate (30) by four tie rods (47) directly over the guide rod aperture (33*b*) extending through the base plate (30). The aperture (33*b*) is adapted to receive a guide rod (71*b*, see FIG. 1A), which extends vertically from the female connector (60, see FIG. 1A). During connector (10) engagement procedures, as explained below, the guide rod (71*b*) extends through the guide rod aperture (33*b*), through the vertical hole in the lower end cap (44*a*), and into the tube (41), pushing the piston (42) in the upward direction, against the force of the spring (46).

As stated above and further depicted in FIG. 2A, the male connector (20) further comprises a base plate (30) supporting a cage assembly (35), which surrounds the ball valve (52) and the spring apparatus (40). The cage assembly (35) protects the ball valve (52) and the spring apparatus (40) from external tools or objects (not shown) making contact with and causing damage to these components. The depicted cage assembly (35) comprises an upper plate (31) and a plurality of bars (32*a-h*, 32*d-e* not shown) extending between the upper plate (31) and the base plate (30). The upper ends of the bars (32) can be welded to the upper plate (31) while the lower ends of the bars can be retained within complementary tubular extrusions (51*a-f*, 51*d-e* not shown) extending from the upper side (30*b*) of the base plate (30). Two of the bars (32*g*, 32*h*) are shown welded to the upper side (30*b*) of the base plate (30), thereby retaining the cage assembly (35) fixed to the base plate (30). In the embodiment of the male connector (20) depicted in FIG. 2A, the upper plate (31) is depicted having a circular shape and positioned about the upper extension pipe (56), above the lower flange (56*a*). The upper plate (31) is shown comprising two halves, adapted to be joined by bolts, enabling the cage assembly (35) to be assembled around the ball valve (52) and the spring apparatus (40), as described above. The ability to separate the upper plate (31), allows the cage assembly (35) to be installed or removed about the ball valve (52) and the spring apparatus (40) without disconnecting the extension pipes (56, 58). It should be understood that FIG. 2A depicts a single embodiment of the male connector (20) and that in alternate embodiments, the cage assembly (35) may comprise a different configuration without departing from the scope of the present disclosure. For example, the upper plate may be welded or otherwise attached directly to the upper extension pipe (56). In other embodiments (not shown), the rods (32) may be threadably connected to both the upper plate (31) and/or the base plate (30). In yet another embodiment (not shown), the plurality of rods (32) may include more or less than the eight rods (32*a-h*) in the embodiment depicted in FIG. 2A.

Referring again to FIG. 2A, the depicted male connector (20) further comprises two buoyancy modules (36*a*, 36*b*) usable to provide buoyancy to the male connector (20) or the connector assembly (10) when submerged in seawater. The buoyancy modules (36*a*, 36*b*) comprise an outer frame (37*a*, 37*b*) retaining a plurality of air canisters (38) therein. The air canisters (38) are adapted to be filled with seawater or evacuate seawater in order to adjust the buoyancy of the male connector (20) or the entire connector assembly (10) during operation. As further depicted in FIG. 2A, the buoyancy modules (36*a*, 36*b*) are connected to the cage assembly (35) by a plurality of clamps between the outer frame (37*a*, 37*b*) and the cage assembly (35). It should be understood that while FIG. 2A depicts a cage assembly (35) and buoyancy modules (36*a*, 36*b*), in other embodiments (not shown) of the male connector (20), all or any portion of the cage assembly (35) and/or the buoyancy modules (36*a*, 36*b*) can be omitted without departing from the scope of the present disclosure.

Figure 3A:
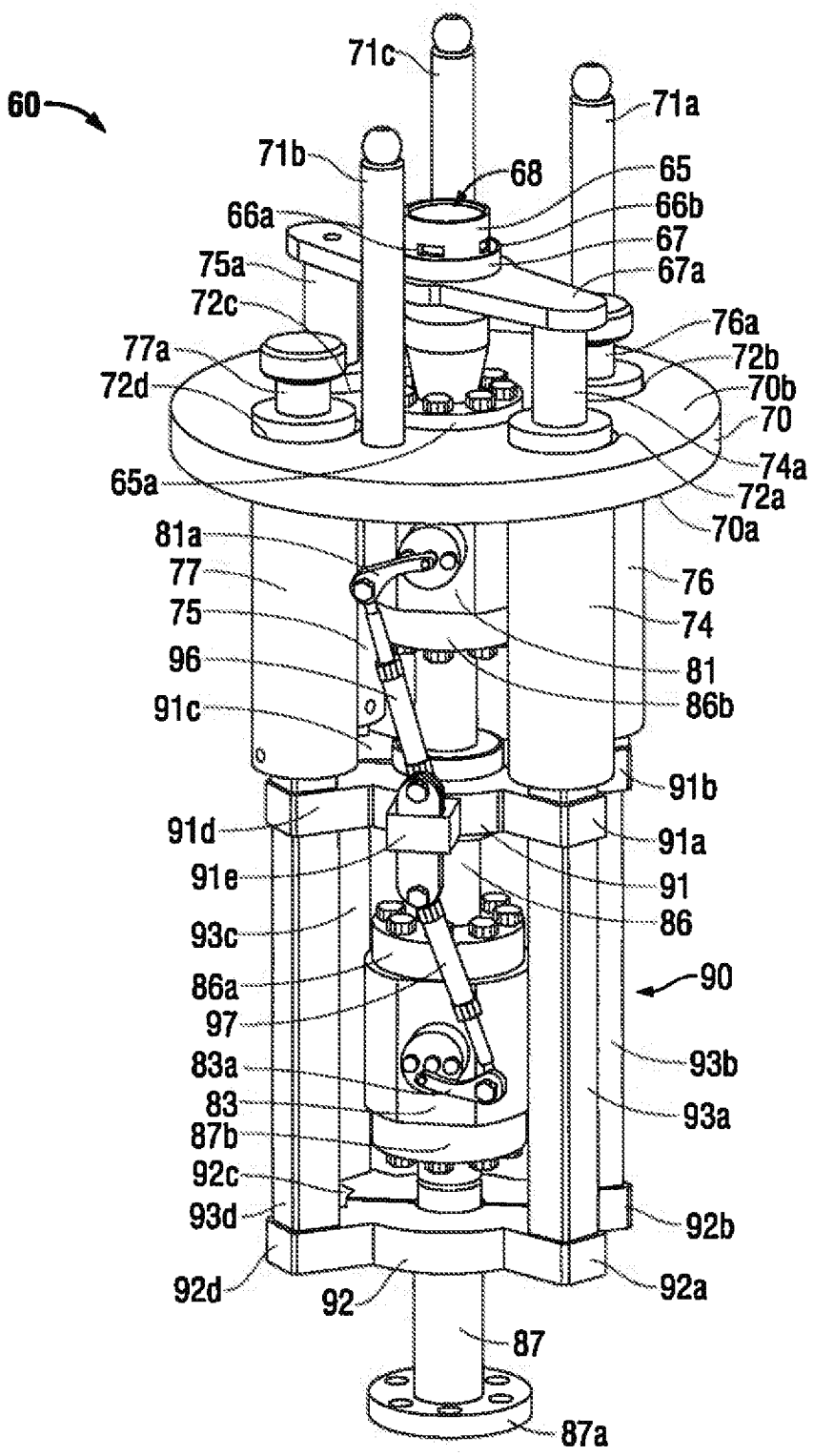
FIGS. 3A and 3B depict an isometric view and a cross-sectional side view and of an embodiment of a female connector that is usable within the scope of the present disclosure are shown.
Figure 3B:
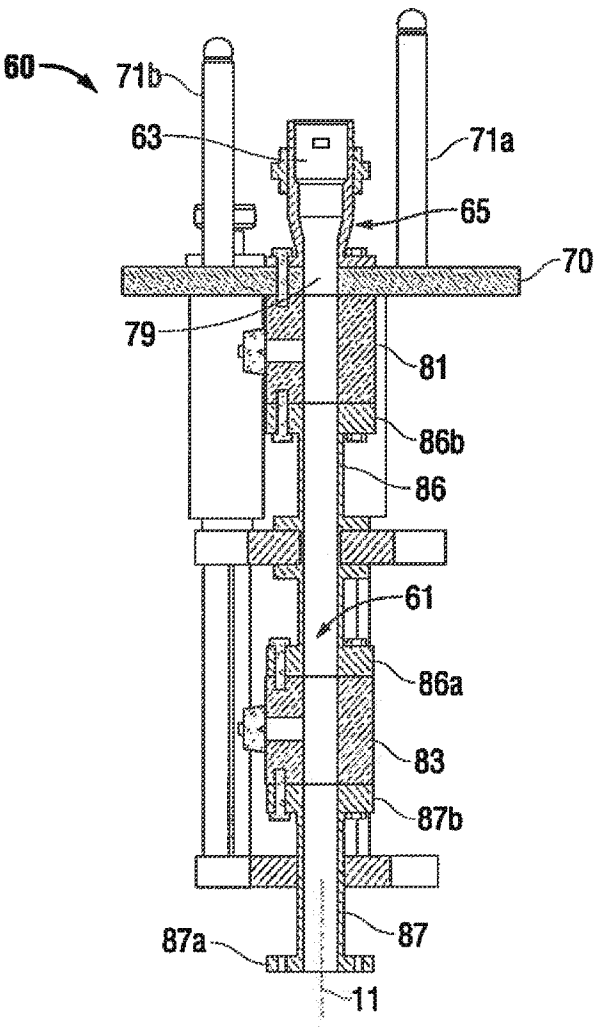

Referring now to FIGS. 3A and 3B, an isometric view and a cross-sectional side view and of an embodiment of a female connector (60) usable within the scope of the present disclosure are shown. The female connector (60) is shown comprising several components connected inline to define a fluid passageway (61) extending along the longitudinal axis (11) thereof. The components forming the fluid passageway are the receptacle (65), the lower base plate (70), the upper ball valve (81), the upper extension pipe (86), the lower ball valve (83), and the lower extension pipe (87).

As shown in FIGS. 3A and 4 depicting the female connector (60), the uppermost component defining the fluid passageway is the receptacle (65). The receptacle (65) is shown having a generally cylindrical configuration and comprising a central cavity (68) extending therethrough along the central axis (11) thereof. The lower end of the receptacle comprises a flange (65*a*) configured to make a fluid connection with the upper surface (70*b*) of the lower base plate (70). In alternate embodiments of the female connector (60), the receptacle (65) may include any connection type between the receptacle (60) and lower base plate (70). For example, the lower end of the receptacle (65) may comprise a female thread, a male thread, other types of flanges, or any other means for establishing a fluid connection (not shown).

The receptacle (65) is further depicted comprising four rectangular apertures (66*a-d*, 66*c* and 66*d* not shown) extending laterally therethrough, adjacent to the upper end thereof, opposite the flange (65*a*). The apertures (66*a-d*) can be symmetrically spaced relative to each other and configured to receive the four latches (24*a-d*, 24*b* and 24*d* not shown) extending from the stab (25). The receptacle (65) can comprise a tapered or a cone shaped upper edge (65*b*), which can contact the latches (24*a-d*) during stab connection operations. The upper edge (65*b*) can lessen the friction between the receptacle (65) and the latches (24*a-d*), allowing the latches to retract into their cavities (27*a-d*, 27*b* and 27*d* not shown) with less required force. Furthermore, the upper portion of the internal surface of the receptacle (65), referred to as the internal sealing surface (63, shown in FIG. 4), can be adapted to receive the sealing section (23) of the stab (25). Specifically, when the stab (25) and the receptacle (65) are engaged, as depicted in FIG. 4, the sealing section (23) forms a fluid seal against the internal sealing surface (63). While the embodiment depicted in FIGS. 3A and 4 includes four apertures (66*a-d*, 66*d* not shown), which are generally equidistantly spaced about the receptacle (65), other embodiments (not shown), usable within the scope of the present disclosure, can include any number, shape, size, and/or configuration of receptacles adapted to accept the corresponding latches.

Referring again to the embodiments shown in FIGS. 3A and 4, the female connector (60) further comprises a sleeve (67) slidably positioned about the receptacle (65), wherein the sleeve has an inside diameter being sufficiently larger to allow the sleeve free movement about the receptacle. The sleeve (67) is shown comprising a generally tubular configuration having a tapered or a cone shaped upper edge (67*b*), adapted to contact the latches (24*a-d*, 24*b* and 24*c* not shown in FIG. 4), and a bracket member (67*a*), extending laterally therefrom, adapted to connect the sleeve (67) to the piston rods (74*a*, 75*a*) of the unlocking hydraulic cylinders (74, 75). As depicted in FIG. 3A, the upper ends of the unlocking cylinders (74, 75) protrude through the lower base plate (70), wherein the unlocking cylinders (74, 75) are positioned on opposite sides of the receptacle (65) and in a generally parallel configuration with respect to the receptacle (65). Although FIG. 3A depicts the sleeve (67) being connected to two hydraulic cylinders (74, 75), the sleeve (67) can be moved about the receptacle (65) by any number of hydraulic cylinders or by other mechanical actuators (not shown). As further depicted in FIGS. 3A and 3B, the lower end of the receptacle (65) terminates with a flange (65*a*), which is connected to the upper face (70*b*) of a lower base plate (70). The flange (65*a*) is shown bolted to the lower base plate (70), being positioned concentrically about a central aperture (79, see FIG. 3B) at the center of the lower base plate (70).

FIG. 3A also depicts the lower base plate (70) as a generally flat circular plate having a heavy-duty construction adapted to withstand large bending forces transmitted thereto by three guide rods (71*a-c*) extending therefrom. The depicted guide rods (71*a-c*) are positioned around the receptacle (65) and configured to enter the corresponding apertures (33*a-c*, 33*c* not shown) extending through the base plate (30), as depicted in FIGS. 1A and 1B. As further shown in FIGS. 1A and 1B, each guide rod (71*a-c*) is shown having a generally cylindrical shape with a rounded upper end, which can contact the angled interior surface of a respective conical guide (34*a-c*, 34*c* not shown) of the male connector (20), such that each guide rod (71*a-c*) is inserted into a respective conical guide (34*a-c*) of the base plate (30), thereby allowing proper engagement of the connector assembly (10). During connector assembly (10) engagement and disengagement procedures, the guide rods (71*a-c*) maintain the male connector (20) in proper alignment for engagement with the female connector (60).

Once the connector assembly (10) is in the engaged position, as depicted in FIG. 1B, the guide rods (71*a-c*) can reinforce the integrity of the connection between the male (20) and the female (60) connectors. Specifically, the guide rods (71*a-c*) can prevent and/or minimize the bending forces, between the male (20) and female (60) connectors, from being transferred to the stab section (25) and the receptacle (65). In the connector assembly (10 depicted in FIG. 1B), a portion of the external bending forces, between the male (20) and female (60) connectors, supported by the guide rods (71*a-c*), the base plate (30), and the lower base plate (70), can maintain proper alignment between the stab section (25) and the receptacle (65) and can prevent damage thereto. Maintaining the stab section (25) and the receptacle (65) oriented in a straight and/or linear relationship relative to one another enables the formation of a proper fluid seal therebetween. Proper orientation of the sealing area (23) and the sealing surface (63), both shown in FIG. 4, can prevent fluids from breaching the connector.

FIG. 3A also depicts the lower base plate (70) having four additional apertures (72*a-d*) extending vertically therethrough and spaced around the receptacle (65). Two of the apertures (72*a*, 72*c*) are adapted to receive the unlocking hydraulic cylinders (74, 75) extending therethrough, while the other two apertures (72*b*, 72*d*) are adapted to receive the separation hydraulic cylinders (76, 77) extending therethrough. As depicted in FIGS. 1A and 3A, the separation hydraulic cylinders (76, 77) comprise piston rods (76*a*, 77*a*), adapted to contact the base plate (30) and to push the male connector (20) away from the female connector (60) until the guide rods (71*a-c*) exit the guide rod apertures (33*a-c*, 33*c* not shown) and the male connector (20) is fully disengaged from the female connector (60). In alternate embodiments (not shown) of the female connector (60), the upper ends of the hydraulic cylinders (74, 75, 76, 77) may be threaded directly into the lower base plate (70), mounted to the lower base plate (70) with a cylinder flange, or attached to the lower base plate by any means known in the industry.

As further depicted in FIGS. 3A and 3B, the lower face (70*a*) of the lower base plate (70) is connected to the upper side of the upper ball valve (81) usable to selectively allow or shut off fluid flow through the fluid passageway (61) of the female connector (60). The upper ball valve (81) comprises a lever (81*a*) usable to shift the upper ball valve (81) between the open and closed positions. As shown, the lower side of the upper ball valve (81) is connected to the upper flange (86*b*) of the upper extension pipe (86), which can also comprise a lower flange (86*a*), connected with the upper side of the lower ball valve (83). The depicted lower ball valve (83) can comprise a lever (83*a*) that can be usable to shift the lower ball valve (83) between the open and closed positions. The lower side of the lower ball valve (83) is shown connected to the upper flange (87*b*) of the lower extension pipe (87), which can also comprise a lower flange (87*a*) that can be adapted to form a fluid connection with an external fluid conduit (not shown). Although FIGS. 3A and 3B depict the upper and lower extension pipes (86, 87) comprising flange connections (86*a*, 86*b*, 87*a*, 87*b*), in alternate embodiments of the female connector (60), the extension pipes (86, 87) may comprise other connection types known in the industry, including male and/or female threads (not shown). Lastly, although FIGS. 3A and 3B depict ball valves (81, 82), it should be understood that in alternate embodiments (not shown) of the female connector (60), other flow control or flow shutoff valves known in the industry, such as butterfly valves, gate valves, globe valves, or any other valves, may be used.

As further depicted in FIG. 3A, the female connector (60) further comprises a support assembly (90), which maintains in position two shut-off hydraulic cylinders (96, 97), two unlocking hydraulic cylinders (74, 75), and two separation hydraulic cylinders (76, 77). The support assembly (90) also partially surrounds the lower ball valve (83) and the lower shut-off cylinder (97), and protects the lower ball valve (83) and the lower shut-off cylinder (97) from external tools or objects (not shown) making contact with, and causing damage to, these components.

The embodiment of the female connector, shown if FIG. 3A, also depicts a support assembly (90) for supporting hydraulic cylinders (74, 75, 76, 77, 96, 97). The depicted support assembly (90) comprises an upper bracket (91), a lower bracket (92), and four vertical bars (93*a-d*) extending therebetween. Specifically, the upper bracket (91) is depicted comprising a circular central aperture, four rectangular apertures (91*a-d*) extending vertically therethrough, and a rectangular protrusion (91*e*) extending laterally therefrom. The upper bracket (91) splits into two halves, which can be bolted together about the upper extension pipe (86) between the upper and lower ball valves (81, 83). FIG. 3A shows the four apertures (91*a-d*) supporting the four vertical bars (93*a-d*) extending therethrough. The upper ends of two of the vertical bars (93*a*, 93*c*) are connected to the lower ends of the unlocking cylinders (74, 75), maintaining the unlocking cylinders (74, 75) in a vertical position extending through corresponding apertures (72*a*, 72*c*) in the lower base plate (70). The upper ends of the two remaining vertical bars (93*b*, 93*d*) are connected to the separation cylinders (76, 77), maintaining the cylinders (76, 77) in a vertical position extending through corresponding apertures (72*b*, 72*d*) in the lower base plate (70). The protrusion (91*e*) contains a clevis mount on the top and bottom side thereof, wherein the upper clevis mount pivotally connects to the upper shut off cylinder (96) and lower clevis mount pivotally connects to the lower shut off cylinder (97). The fifth protrusion provides support to the upper and lower shut off cylinders, enabling the cylinders to actuate the upper and lower ball valves (81, 83).

As depicted in FIG. 3A, the support assembly (90) further comprises a lower bracket (92) having a central aperture and four rectangular cavities (92*a-d*) extending vertically therein. The lower bracket (91) splits into two halves, which can be bolted together about the lower extension pipe (87) below the lower ball valve (83). FIG. 3A shows the four cavities (92*a-d*) supporting four vertical bars (93*a-d*) positioned therein, preventing the vertical bars (93*a-d*), from moving horizontally or vertically.

In order to actuate the hydraulic cylinders (74, 75, 76, 77, 96, 97) depicted in FIG. 3A, the female connector (60) also requires a plurality of fluid fittings (not shown) and fluid hoses (not shown) to deliver and evacuate pressurized fluids to and from said hydraulic cylinders. Although these fittings and hoses are not shown, such fluid connectors and conduits are known in the industry, and are included within the scope of the present disclosure.

Embodiments usable within the scope of the present disclosure also relate to methods of connecting subsea fluid conduits. Referring again to FIG. 1A, a side view of an embodiment of the connector apparatus (10) is shown. Specifically, the Figure depicts the male connector (20), which can be attached to an upper fluid conduit (not shown) via the upper flange (56*b*), being lowered toward engagement with the female connector (60), which can be attached to a lower fluid conduit or an item of well equipment (not shown). A ROV or a diver can maneuver or guide the male connector (20) during this process by gripping the handles (57). As the male connector (20) nears the female connector (60), the upper ends of the guiding rods (71*a-c*) can contact the conical guides (34*a-c*, 34*c* not shown) of the male connector (20), such that the male connector (20) can be oriented into proper alignment for engagement with the female connector (60). When the guide rods (71*a-c*) enter the corresponding guide rod apertures (33*a-c*, 33*c* not shown), the male connector (20) can be properly aligned with the female connector (60), enabling the stab (25) to mate with the receptacle (65).

Referring now to FIG. 5, as the second guide rod (71*b*) moves through the second guide rod aperture (33*b*), the upper end of the guide rod (71*b*) enters the tube (41) of the spring apparatus (40). The guide rod (71*b*) pushes against the lower end of the piston (42), lifting the piston upwards against the force of the spring (46). As the piston (42) moves upwards within the tube (41), it pushes the rod (43) and the extension link (45) upwards, rotating the lever (53) and actuating the flow control valve (52) to the open position.

Referring again to FIG. 4, the Figure depicts a cross-sectional close-up view of the stab (25) and the receptacle (65) in an engaged position. As the male connector (20) further approaches the female connector (60), the stab (25) enters the receptacle (65), wherein the nose cone (22), shown in FIGS. 1A and 4, helps in guiding the stab (25) into the receptacle (65). Specifically, as the stab (25) enters the receptacle (65), the nose cone (22) can make contact with the upper edge (65*b*) and/or the internal sealing surface (63) of the receptacle (65), guiding the stab (25) into proper alignment with the receptacle (65). Once the nose cone (22) is inserted into the receptacle (65), the stab (25) is lowered until the front sloped surfaces (54*a-d*, 54*b* and 54*d* not shown) of the latches (24*a-d*, 24*b* and 24*d* not shown) contact the cone-shaped upper edge (65*b*) of the receptacle (65).

Moving the stab (25) further into the receptacle (65), causes the cone-shaped upper edge (65*b*) to force the latches (24*a-d*) to retract into their respective receptacles (27*a-d*, 27*b* and 27*d* not shown), overcoming the force of the springs (29*a-d*, 29*b* and 29*d* not shown). As the latches (24*a-d*) move further down within the receptacle (65), they become aligned with the rectangular apertures (66*a-d*, 66*b* and 66*d* not shown) and extend therethrough, locking the stab (25) within the receptacle (65). FIGS. 1B and 4 show the latches (24*a-d*) extending through the apertures (66*a-d*), thereby preventing disconnection between the stab (25) and the receptacle (65). Once the stab (25) fully engages the receptacle (65), the sealing section (23) seals against the internal sealing surface (63) and prevents fluids from breaching the connector assembly (10).

Furthermore, during the course of engagement between the male and the female connectors (20, 60), or following full engagement depicted in FIG. 1B, both shut-off hydraulic cylinders (96, 97) can be powered by external hydraulics (not shown) to actuate the upper and the lower ball valves (81, 83) to the open position. At this point, the male connector (20) and the female connector (60) are fully engaged, the ball valves (52, 81, 83) are shifted to the open positions, and fluids can be communicated through the connector assembly (10).

Embodiments usable within the scope of the present disclosure also relate to methods for terminating a fluid connection with a fluid connector assembly (10). During the course of operations or in the event of an emergency that requires disconnection, the male and female connectors (20, 60) can be quickly disengaged. Referring again to FIGS. 1B and 4, an isometric view and a cross-sectional close-up view of an embodiment of the connector assembly (10) in the engaged position, is shown. In order to disengage the stab (25) from the receptacle (65), the latches (24*a-d*, 24*b* and 24*d* not shown) are retracted into their respective cavities (27*a-d*, 27*b* and 27*d* not shown) by the sleeve (67). During disengagement, the sleeve (67) can be moved upwards against the latches (24*a-d*) by extending both unlocking hydraulic cylinders (74, 75) using external hydraulics (not shown). As the sleeve (67) moves in the upward direction, the cone-shaped upper edge (67*b*) can come into contact with the front sloped surfaces (54*a-d*, 54*b* and 54*c* not shown) of the latches (24*a-d*), forcing the latches (24*a-d*) to retract into their respective receptacles (27*a-d*) against the force of the springs (29*a-d*). The cone-shaped or inwardly sloping front edge (67*b*) of the sleeve (67) and the front sloping surfaces (54*a-d*) of the latches (24*a-d*) can enable the sleeve (67) to force the latches (24*a-d*) into their respective cavities (27*a-d*) with lesser-required force. Once the sleeve (67) fully covers the rectangular apertures (66*a-d*, 66*b* and 66*d* not shown), the latches (24*a-d*) are sufficiently retracted to allow the stab (25) to be pulled out and fully disconnected from the receptacle (65). Specifically, as the stab (25) is pulled from the receptacle (65), the latches (24*a-d*) are forced to retract further into the cavities (27*a-d*), by the walls of the rectangular apertures (66*a-d*), until they are fully retracted therefrom.

In order to fully separate the male connector (20) from the female connector (60), as depicted in FIGS. 1A and 3A, the separation cylinders (76, 77) can be powered by external hydraulics (not shown) and moved against the male connector (20) to facilitate the separation. Specifically, the separation hydraulic cylinders (76, 77) can extend their rods (76*a*, 77*a*) against the base plate (30) to push the male connector (20) away from the female connector (60), thus separating them. The separation cylinders (76, 77) can be configured to have a stroke of sufficient length to push the male connector (20) beyond the guide rods (71*a-c*), such that the guide rods can be disengaged from the corresponding guide rod apertures (33*a-c*, 33*c* not shown). At this point, the male connector (20) can be moved as desired, independent of the female connector (60), through use of a ROV, a diver, or by other means.

In addition, during separation, as the second guide rod (71*b*) is being retracted from the second guide rod aperture (33*b*), the ball valve (52) of the male connector (20) can be simultaneously actuated to the closed position. Specifically, as the second guide rod (71*b*) is retracted from the spring apparatus (40), depicted in FIG. 5, the piston (42) is free to move in the downward direction under the force of the spring (46). As the piston (42) is forced downwards, the rod (43) and the extension link (45) pull on the lever (53), actuating the ball valve (52) to the closed position, thereby cutting off fluid flow through the male connector (20) and preventing fluids in the upper conduit (not shown) from spilling into the water after disconnection.

Furthermore, prior to separation of the male (20) and the female connector (65), both shut-off hydraulic cylinders (96, 97), depicted in FIG. 3A, can be powered by external hydraulics (not shown) to actuate the upper and the lower ball valves (81, 83) to the closed position, thus cutting off fluid flow through the female connector (60) and preventing fluids in the lower conduit (not shown) from spilling into the water after disconnection. Once the ball valves (52, 81, 83) are closed and the fluids within the upper and lower conduits are trapped therein, the male and female connectors (20, 60) can be safely separated.

Figure 6:
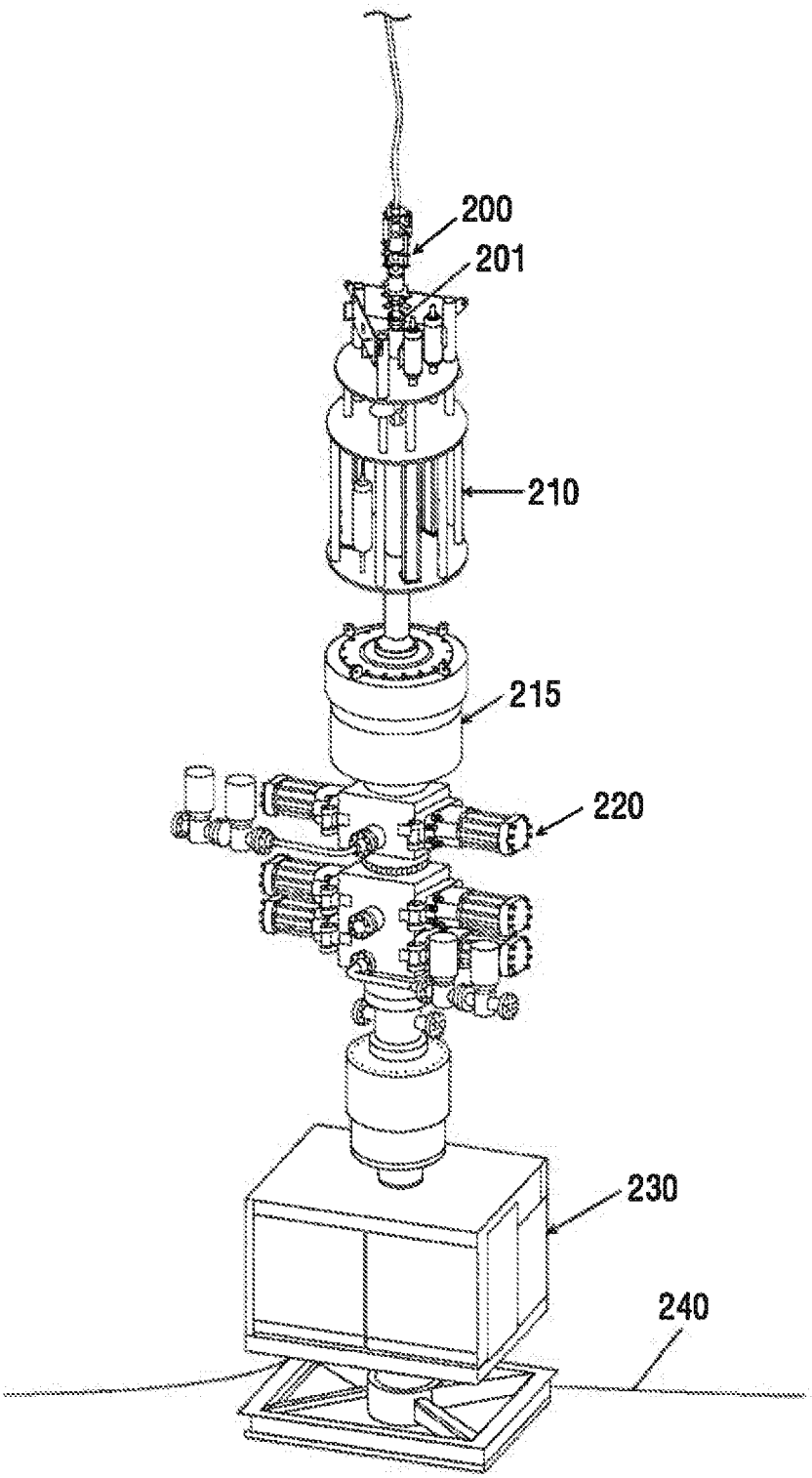
FIG. 6 depicts a general arrangement and integration lay out of an embodiment of the emergency pipe stroker tool with emergency quick disconnect system, which is usable within the scope of the present disclosure.

Turning now to FIG. 6, a general overview of the disclosed methods and system are disclosed. Depicted, among other devices, is a coiled tubing/flexible hosing in communication with a platform or a ship above ground and further down the tubing, another section. Moving from an upward to downward position, the coiled tubing continues beneath the clamp to depict an EQD (200) (i.e., in this example embodiment, a dual EQD having an EQD stab (201) in communication with an EPST (210), which is in communication with an annular BOP (215) that connects to a triple multiple BOP (220) in this example embodiment. The triple multiple BOP (220) is connected to a Christmas tree (230), which is on the seafloor (240).

Figure 7B:
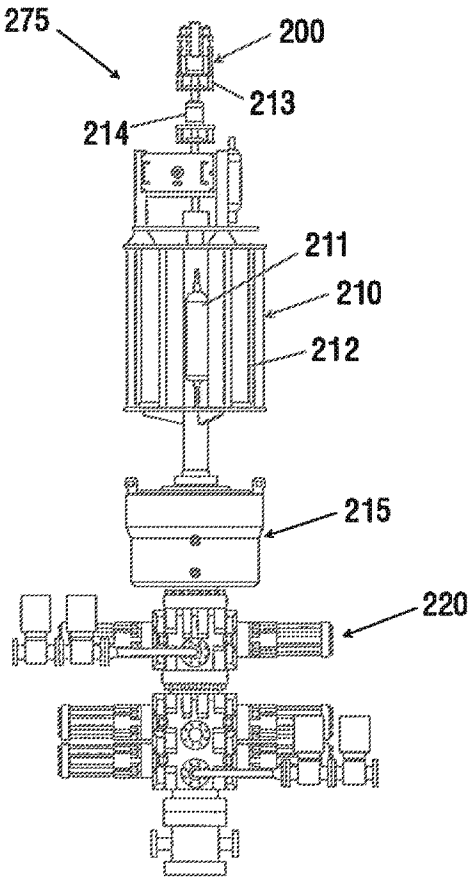
FIGS. 7A and 7B depict various views, including a front view showing an extended/disconnected state of motion (e.g., fully stroked) in FIG. 7A and a front view showing a collapsed/disconnected state of motion in FIG. 7B, of an embodiment of an emergency pipe stroker tool (EPST) used with a triple BOP system, which is usable within the scope of the present disclosure.
Figure 7A:
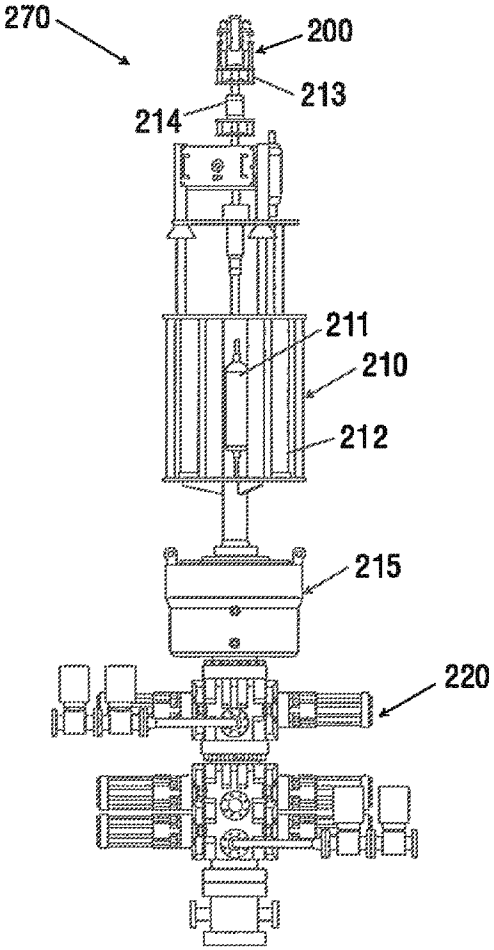

Moving on to FIGS. 7A and 7B, depicted in more detail is the EPST (210). As shown in FIGS. 7A and 7B, a front view of the EPST (210) includes one or more accumulator(s) (211) and hydraulic cylinder(s) (212) connected to the annular (215), which may be connected to a triple BOP system (220) and Christmas tree (not shown). A dual ball valve EQD (213), controlled by the EQD panel (214), can be in communication with the one or more accumulator(s) (211). In alternative embodiments, other types of valves may be used. In non-depicted embodiments, the pipe or tubulars, as well as the bowls and slips of the EPST (210) for clamping and gripping the pipe or tubulars, may be shown. FIGS. 7A and 7B show the front view of the EPST (210) frozen in the two states (270, 275, respectively) of the motion, namely the first state being extend(ed)/disconnected (270) as shown in FIG. 7A, and the second state being collapse(d)/disconnected (275) as shown in FIG. 7B. Drawn to the same scale, the extend(ed)/disconnected state (270), e.g., fully stroked, is longer than the collapse(d)/disconnected state (275). An isometric view of the disclosed methods and system shows the cross-over flange to the EQD (200).

With reference to FIG. 8 and in top-down order, the lower portion (207) of the EPST can be stung into a perforating assembly (235), and, specifically, this may occur at the upper cement retainer portion (231*a*). Below the upper cement retainer portion (231*a*) are shown one or more flapper and/or check valves (232*a*), which may connect via a funnel guide (233) to another section (208). More sections can be connected via funnel guide(s), and with the use of additional flapper and/or check valves (232*b*), and then the assembly (235) can terminate in the perforating gun (234) of the perforating assembly (235). The perforating assembly (235) may be actuated remotely by use, for example, of one or more firing head mechanisms. In one example embodiment, the total length of the perforating assembly (235) can be 108 inches, but this length can vary in other embodiments.

In FIG. 9, another example embodiment is depicted in accordance with the disclosed methods and systems. FIG. 9 visually depicts top, middle and bottom interconnected sections in a non-connected, labeled view. The bottom section is the tree 301 that may be located on the seafloor in a subsea environment. Tree 301 may have a male connector for mating with a female receptacle, e.g., a drilquip mandrel 302. As shown, above and surrounding the mandrel 302 are located a tree running tool (TRT) panel 303 topped by a TRT control panel 304 and a lower EQD accumulator package 305. The mandrel 302 is connected to 7 1/16 inch 10 k to 7 1/16 inch 15 k API flange cross-over 306 that is connected below a 3-inch ball valve with 7 1/16 15 k flange 307. A 7 1/16 inch pump in sub 309 has a t-connection, wherein the bottom of the "t" is connected to the sub's 309 7 1/16 inch API 15 k flange 308, which is connected to the ball valve's flange 307. The middle of the "t" is where the pump in sub 309 has a 2 1/16 inch 15 k API flange 316 connected to a 2 1/16 inch 15 k to 2 9/16 10 k API flange cross-over 317 that is connected to 2 1/16 10 k API flange 318 in communication with a 2 9/16 10 k API flange 319 that is connected to a first EQD 13 (e.g., connection can be used for chemicals or chemical stimulation and can be disconnection easily and quick with the use of the EQD). The top portion of the "t" has another 7 1/16 inch API 15 k flange 308 that is coupled to a female modular connector 310 to form the top of the middle section.

The female modular connector 310 of the middle section may mate with the male modular connector 311 of the top section of FIG. 9. Like the middle section, the top section can have a t-shaped point of connection centered about another 7 1/16 inch pump in sub 309. The t-shaped point is highlighted merely for ease of discussion herein. The bottom portion of this top section's "t" has the pump in sub 309 connected to a 7 1/16 inch API 15 k flange 30 that is connected to the male modular connector 11. The middle of the "t" is where the pump in sub 309 has a 2 1/16 inch 15 k API flange 316 that can be connected to a 2 1/16 inch 15 k to 2 9/16 10 k API flange cross-over 317 that is connected to 2 1/16 10 k API flange 318 in communication with a 2 9/16 10 k API flange 319, which is shown connected to a second EQD 314 (e.g., for returns). The top portion of this "t" has another 7 1/16 inch API 15 k flange 308 that is coupled to yet another 7 1/16 inch API 15 k flange 308, which is shown connected to an additional pump in sub 309. This additional pump in sub 309 also forms a t-shaped connection about itself. The middle section of this additional "t" is where the additional pump in sub 309 has a 2 1/16 inch 15 k API flange 316 connected to a 2 1/16 inch 15 k to 2 9/16 10 k API flange cross-over 317, which can be connected to a 2 1/16 10 k API flange 318 in communication with a 2 9/16 10 k API flange 319 that is connected to a third EQD 315 (e.g., connection can be used for nitrogen). The top of the additional "t" has the additional pump in sub 309 connected to yet another 7 1/16 inch API 15 k flange 308, which can be topped by a lift eye 7 1/16 inch 15 k flange 312. A top EQD package panel 320 may be connected to any pump in sub 309 in the top section.

Figure 10A:
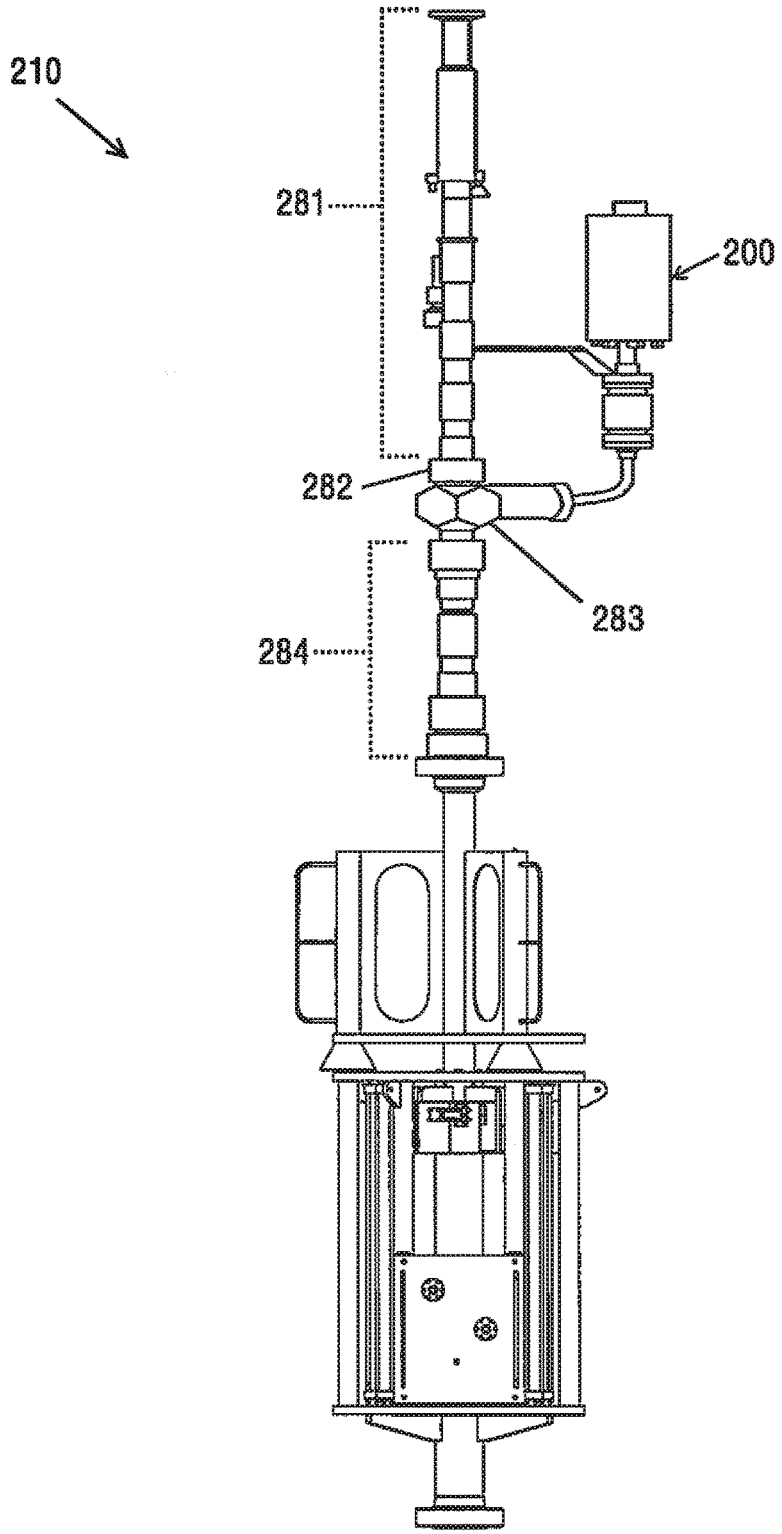
FIGS. 10A and 10B depict alternative embodiments of a modular connector, usable within the scope of the present disclosure.
Figure 10B:
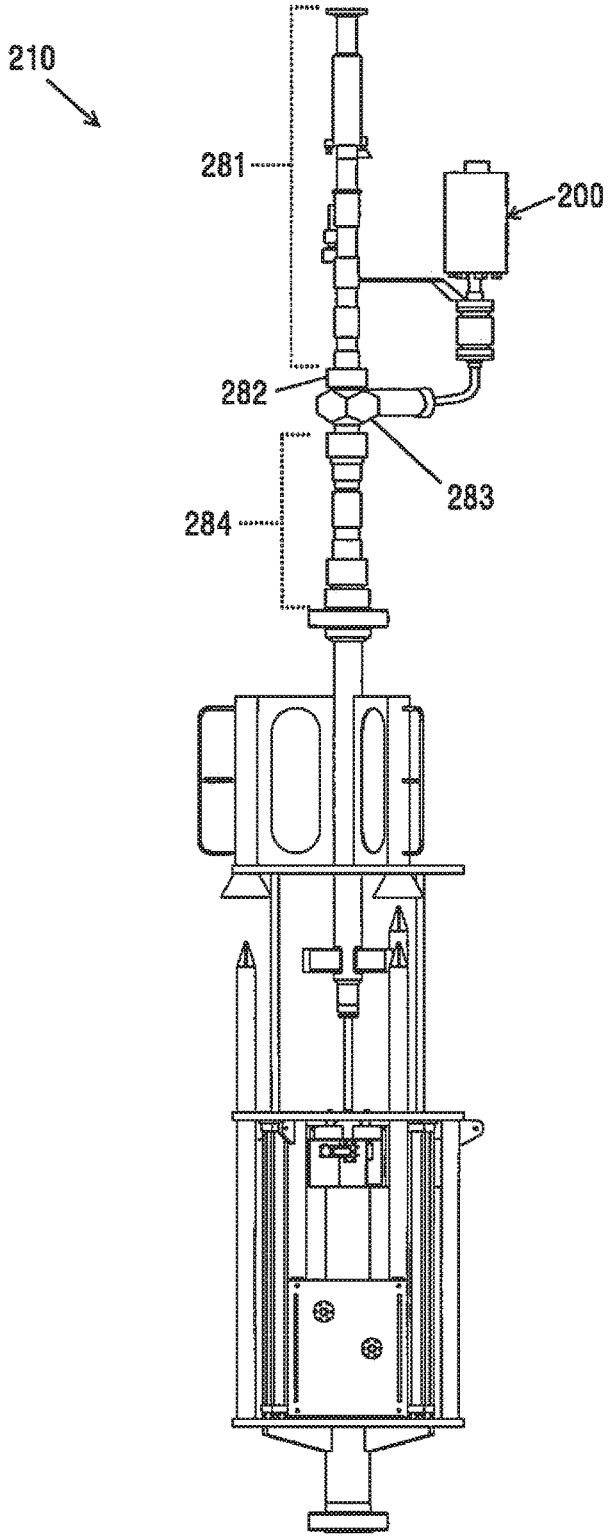

FIGS. 10A and 10B show a discrete section of an EPST (210), usable with an assembly topped by a greasehead (281), which is in communication with a pump in sub (283), wherein FIG. 10A shows the EPST during operation and FIG. 10B shows the EPST during release. The pump in sub (283) can be connected to a lubricator (284), and the pump in sub (283) can connect to one or more EQD systems at a crossover connection (282), through subsea valves. The assembly's (210) long lubricator (284) ultimately can terminate in a connection with a first modular connector apparatus comprising a plurality of components, such as a male modular connector that can be mated with a female modular connector (i.e., receiver connector).

In an embodiment, the female modular connector, of the modular connector apparatus, can connect or communicate with a single or multiple BOP system. The rams of the BOP system can further communicate with a second modular connector that comprises a male modular connector and a female modular connector. The male modular connector can be aligned to connect and communicate with the BOP system on the upper end and the female modular connector on the lower end. The female modular connector can be adapted to connect to a tree (e.g., drilquip tree), via at least one ball valve, other subsea valves, and/or a tree running tool. The female connector can further be adapted to connect to one or more EQD systems, through connections with subsea valves and a pump in sub.

The male modular connector, which can optionally connect in communication with a triple BOP system that terminates in the male modular connection therebeneath for optional connection with a female connector.

A female modular connector receiver can be in communication with a bottom section package. The bottom section package may include one or multiple ROV control ball valves, one or multiple inline double ball valves, and a conduit for a pump in sub. The bottom of the bottom section package can be connected to a tree.

In alternative example embodiments, the male modular connector can mate with a female modular connector. Below this female modular connector a ball valve can be located, which is in operative communication with both a pump in sub and an EQD via subsea valves. Tree running tool ("TRT") panel(s) and TRT control panel(s) can be located at the lower portion of this alternative example embodiment.

Figure 11:
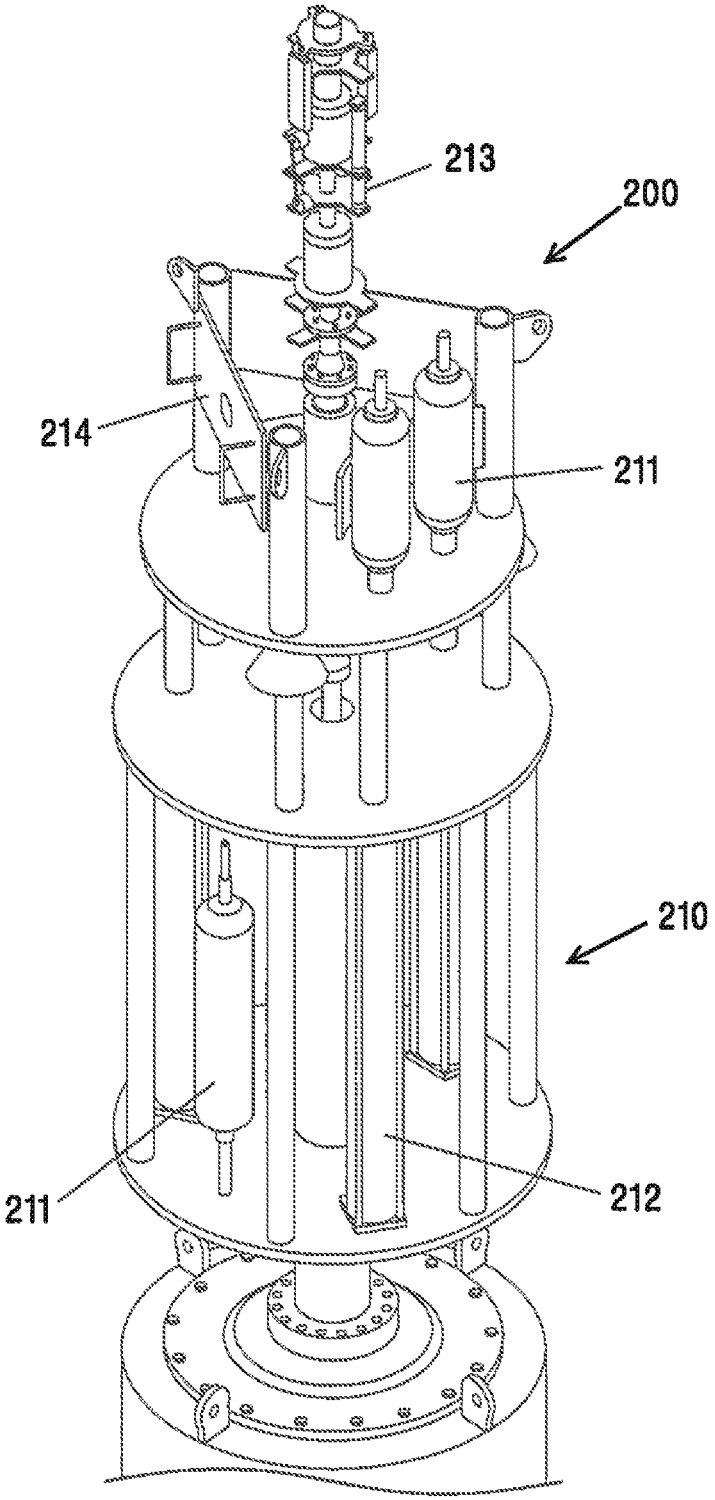
FIG. 11 depicts an embodiment of a modular emergency pipe stroker tool and an emergency quick disconnect system, usable within the scope of the present disclosure.

During the abandonment operations, a modular emergency pipe stroker tool (210) and one or more emergency quick disconnect (200) systems can be used, as shown in FIG. 11, for inserting coiled tubing and/or tubulars that can be used in the abandonment operations. Various embodiments of the modular emergency pipe stroker tool (EPST)

(210) and emergency quick disconnect (EQD) (200) are usable within the scope of the present disclosure for abandonment operations.

Figure 12:
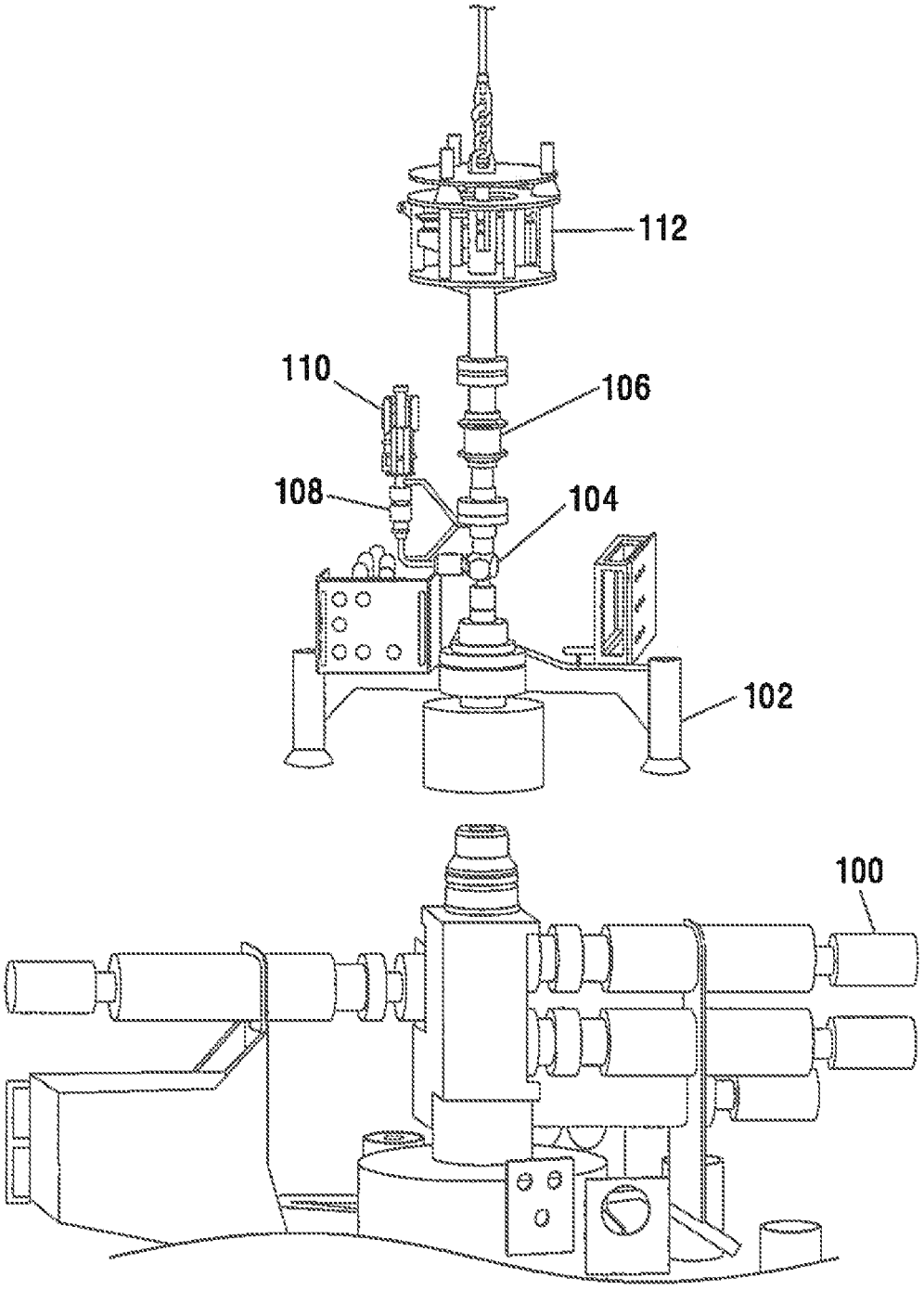
FIGS. 12-17 depict embodiments of an open-water, rigless and riserless plug and abandonment system, usable within the scope of the present disclosure.
Figure 13:
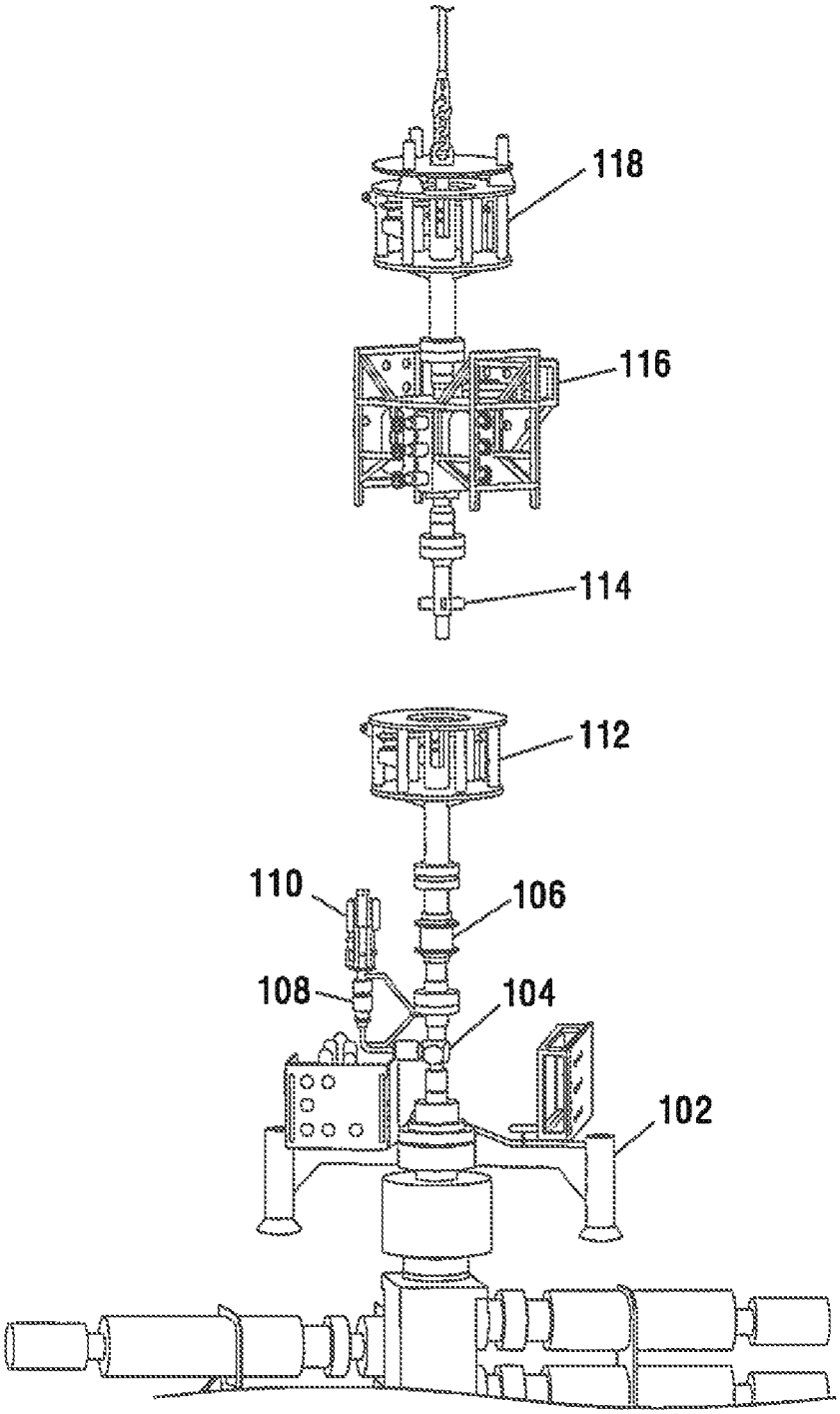

Referring now to FIGS. 12 through 17, the Figures depict an embodiment of a method and system of the present invention relating to open-water, rigless and riserless plug and abandonment operations. The method and system include a subsea installation of a tree running tool panel 102 connected to a female modular connector 112, of a first modular connector apparatus, as shown in FIG. 12. The tree running tool 102, at its lower end, can connect to a tree 100 (e.g., drilquip tree), which can connect to a BOP landing and the seafloor. At its upper end, the tree running tool 102 can connect to the female modular connector 112, via subsea valves and including, for example, a ball valve 106. In addition, one or more emergency quick disconnects 110 can be installed between the female modular connector 112 and the tree running tool 102, through connections of subsea valves 108 and a pump in sub 104, which connects between the tree running tool 102 and the female modular connector 112. Coiled tubing can connect to the one or more EQD systems 110 for use in running in chemicals and/or oil and gas equipment, without the need to change or remove equipment.

Figure 14:
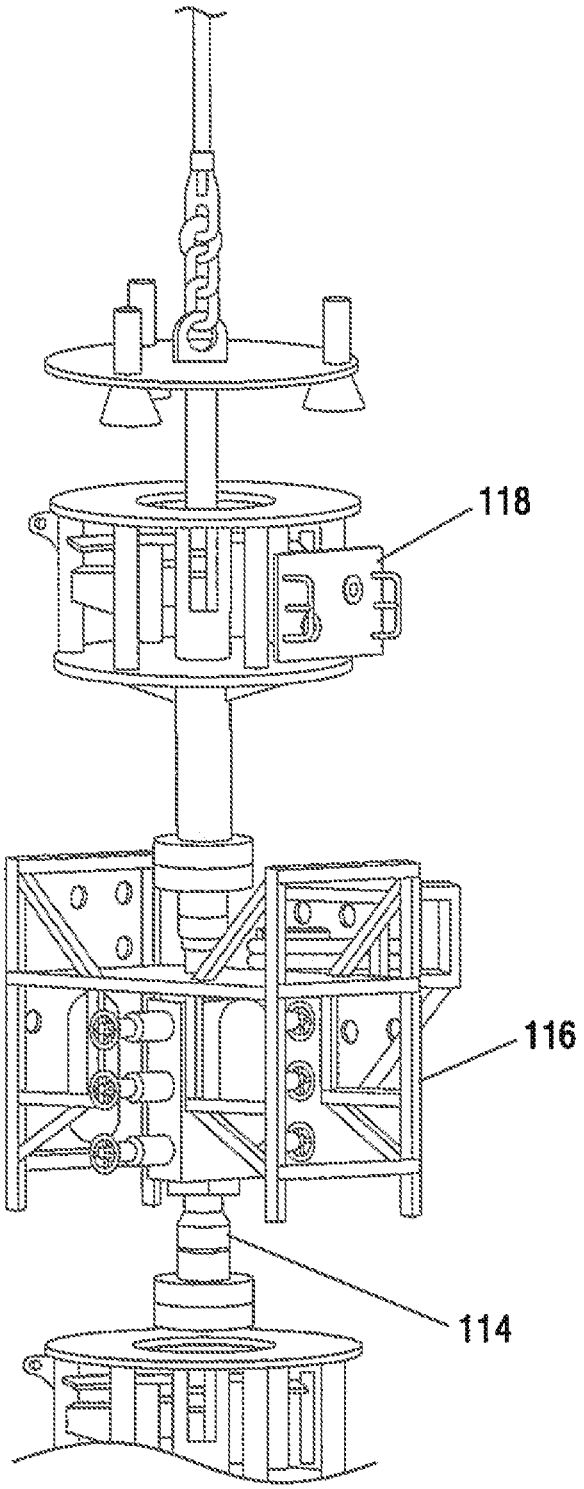

The method and system can further include the female modular connector 112 being aligned with, and connected to, a male modular connector 114, of the first modular connector apparatus, for connecting to a BOP system. The BOP system can include a single or multiple ram system (e.g., triple ram system, as depicted in FIG. 14). As further depicted in FIGS. 13 and 14, the BOP system 116 can be aligned and connected to a second female modular connector 118, of a second modular connector apparatus.

Figure 15:
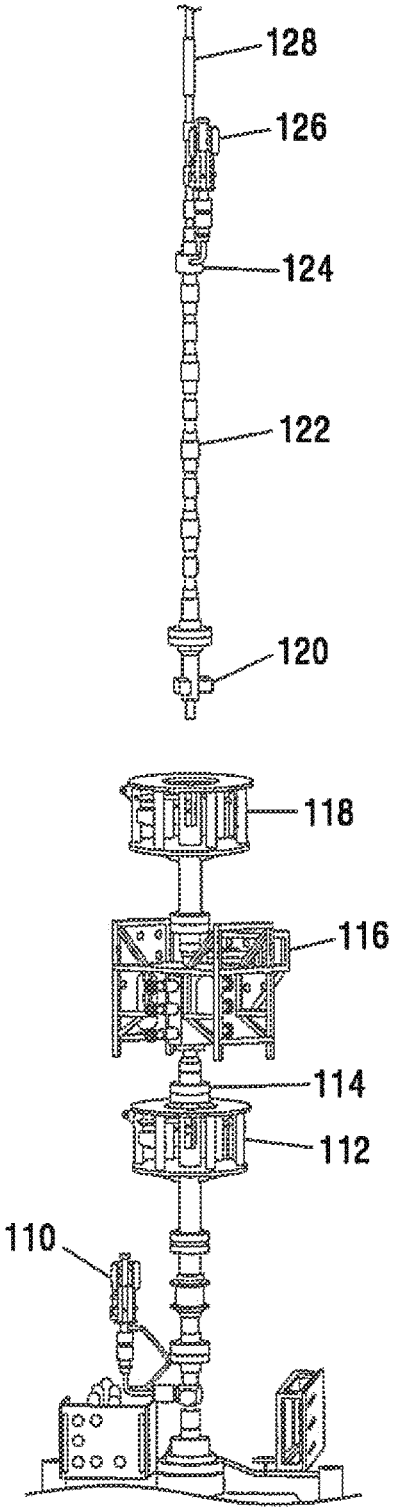
Figure 16:
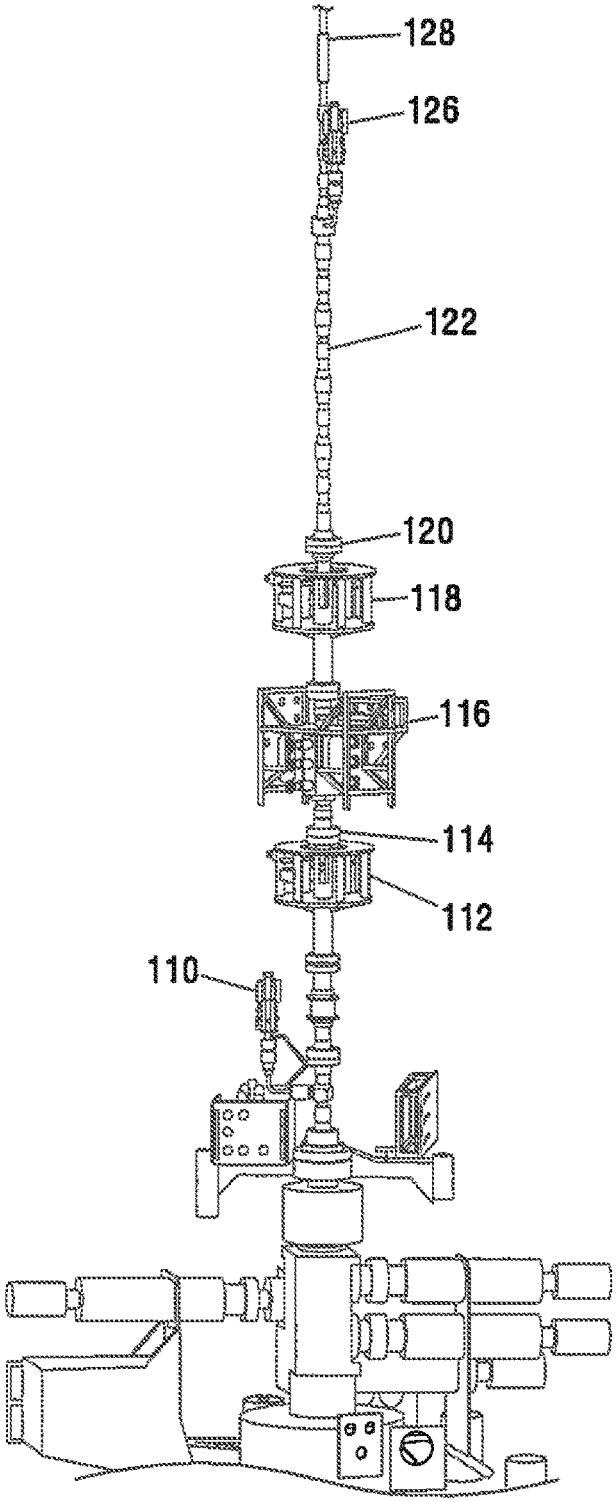
Figure 17:
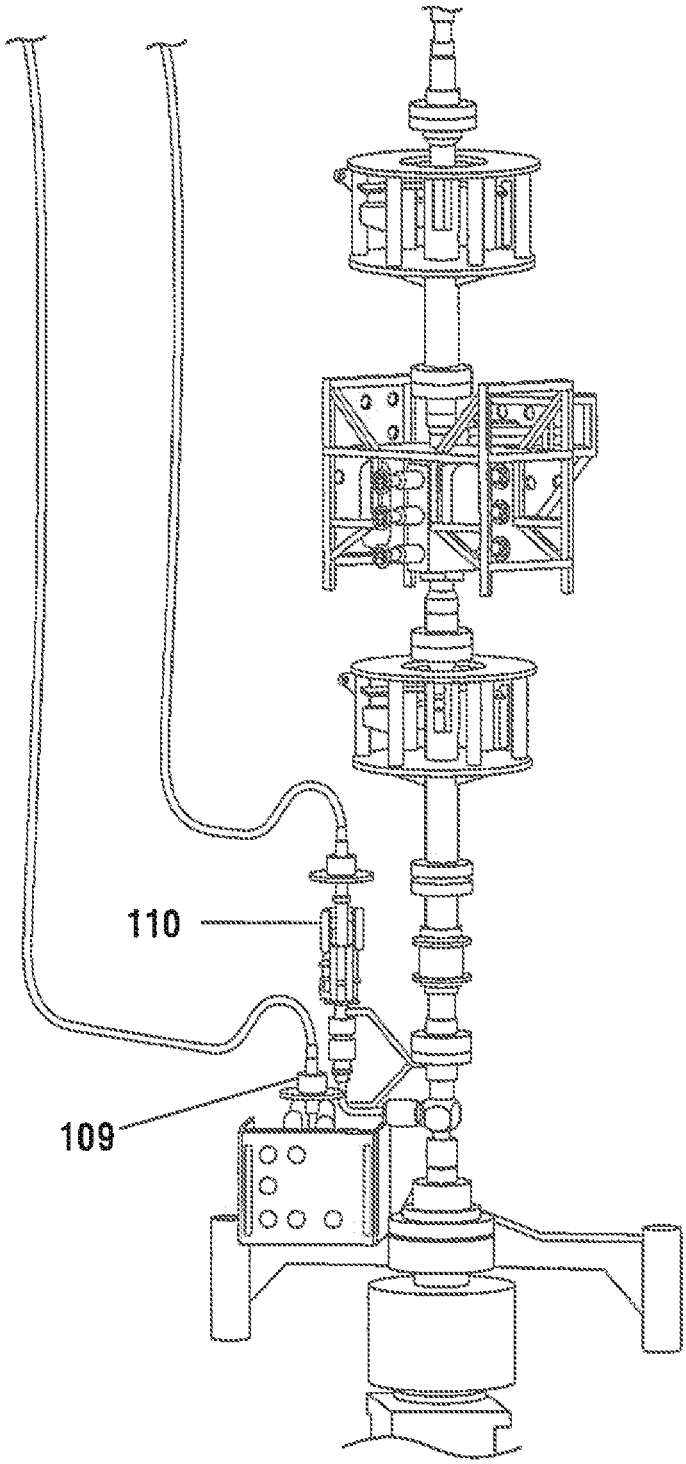

The method and system of the present invention can further include aligning and connecting a second male modular connector 120 to the second female modular connector 118, as shown in FIG. 15. On its upper end, the second male modular connector 120 can connect to a lubricator 122, which can connect to a pump in sub 124 and at least one flange cross-over for connecting to a single EQD 126, or dual EQD systems (not shown), via subsea valves, as shown in FIGS. 15 and 16. A grease head can be connected to the upper end of the lubricators shown in FIGS. 15 and 16, for connecting to coiled tubing or other tubulars, or other oil and gas equipment. As shown in FIG. 17, coiled tubing can be connected at the EQD systems, and can be used for inserting and removing gases (e.g., nitrogen gas), chemicals, and/or oil and gas equipment which can be used in conducting plug and abandonment operations.

The following narrative is illustrative of a procedure usable with the disclosed system and method.

Upon plugging a well and removing any attached tubing, a subsea blowout preventer and an emergency pipe stroker tool are assembled together. A cement retainer, comprising at least one flapper valve, at least one check valve, or combinations thereof in an embodiment, with a perforating gun can be prepared and attached to the well. In embodiments, a funnel guide can be attached and water introduced to the well piping.

The emergency quick disconnect tool is attached to the well in communication with the cement retainer with the aid of a stinger. The cement retainer is pressurized and the perforating gun is actuated.

The emergency pipe stroking tool and the emergency quick disconnect tool can be actuated to seal the well with multiple mechanical barriers in place as secondary containment or safeguards to keep the well in a sealed configuration.

Further steps for plugging and abandonment are well known to persons having ordinary skill in the art. While the general procedure remains similar, it is to be understood that the present invention puts into place multiple safeguards in the form of mechanical barriers to ensure a proper, leak free result.

While the steps of the method have been described sequentially, it is intended that they can be conducted concurrently, or even in a different sequence to accomplish the intended result. Therefore, the method should not be limited to the order disclosed herein.

Various embodiments, usable within the scope of the present disclosure, have been described with emphasis and these embodiments can be practiced separately or in various combinations thereof. In addition, it should be understood that within the scope of the appended claims, the present invention can be practiced other than as specifically described herein.

What is claimed is:

1. A system for sealing a wellbore with multiple mechanical barriers comprising:

an emergency pipe stroker tool comprising a gripping spider configured to clamp or grip a tubular for insertion into or removal from the wellbore;

an annular blowout preventer connected below the emergency pipe stroker tool;

a ram blowout preventer connected below the annular blowout preventer;

a tree connected below the ram blowout preventer on the seafloor; and a cement retainer lowered within the wellbore, the cement retainer comprising;

a first flapper valve;

a second flapper valve located above the first flapper valve; and a perforating gun located below the first flapper valve usable to form one or more perforations in a casing within the wellbore, lining within the wellbore, or into a formation proximate to the wellbore.

2. The system of claim 1, further comprising an emergency quick disconnect tool located above and connected to the emergency pipe stroker tool.

3. The system of claim 2, wherein the emergency quick disconnect tool comprises a connector assembly and a fluid conduit in communication with the well, and wherein the connector assembly is configured to simultaneously detach at least partially from the well and seal the well.

4. The system of claim 2, wherein the emergency pipe stroker tool is configured to automatically actuate the emergency quick disconnect tool in an emergency situation to seal the well.

5. The system of claim 4, wherein the emergency situation comprises a platform drive off, ship drive off, loss of communication with a platform, loss of communication with a ship, or combinations thereof.

6. The system of claim 1, wherein the emergency pipe stroker tool further comprises an actuator for disconnecting a tubular from the well.

7. The system of claim 6, wherein the emergency pipe stroker tool further comprises at least one hydraulic cylinder, wherein the at least one hydraulic cylinder strokes the emergency pipe stroker tool.

8. The system of claim 7, wherein the emergency pipe stroker tool further comprises at least one accumulator, wherein the at least one accumulator provides a pressure storage reservoir containing pressurized fluids.

9. The system of claim 1, wherein the emergency pipe stroker tool further comprises at least one accumulator, wherein the at least one accumulator provides a pressure storage reservoir containing pressurized fluids.

10. The system of claim 1, wherein the emergency pipe stroker tool comprises a connector assembly with at least two connector components.

11. The system of claim 10, wherein the connector assembly comprises at least one valve for sealing the fluid conduit in communication with the well.

12. The system of claim 1, wherein the emergency pipe stroker tool comprises a stinger usable for opening the flapper valves of the cement retainer.

13. The system of claim 1, further comprising cement deposited into the one or more perforations in a casing in the wellbore, lining in the wellbore, or into a formation proximate the wellbore.

14. The system of claim 1, wherein the cement retainer further comprises a funnel guide between the first flapper valve and the second flapper valve.

15. A method of sealing a well, wherein the method comprises the steps of:

i) configuring and positioning an emergency pipe stroker tool for insertion of tubulars into the well, and to act as a first mechanical barrier for well control operations;

ii) attaching a perforating gun to a cement retainer comprising at least one flapper valve, at least one check valve, or combinations thereof, and running the cement retainer and the perforating gun into the well, wherein the cement retainer is configured to act as a second mechanical barrier for well control operations;

iii) inserting a work string of tubulars and a stinger into the well;

iv) forming, with the stinger, an opening in the cement retainer;

v) opening at least one blowout preventer of a blowout preventer system within the well and lowering the emergency pipe stroker tool further into the well;

vi) inserting the emergency pipe stroker tool into the opening in the cement retainer, wherein the emergency pipe stroker tool is in an extended position, and wherein the emergency pipe stroker tool is in mechanical communication with the blowout preventer and the cement retainer at the opening to provide the first mechanical barrier; and vii) gripping at least one tubular of the work string of tubulars with the emergency pipe stroker tool for holding the work string of tubulars within the well.

16. The method of claim 15, further comprising the steps of:

(viii) firing the perforating gun to create a plurality of perforations into a surrounding formation proximate to the well;

(ix) depositing a material into the plurality of perforations, wherein the deposited material seals the well with multiple mechanical barriers;

(x) releasing the emergency pipe stroker tool for removing the work string of tubulars from the well; and (xi) actuating the emergency pipe stroker tool and the emergency quick disconnect tool to seal the well with multiple mechanical barriers and to shear any remaining tubulars attached to the well.

17. The method of claim 16, further comprising the step of attaching an emergency quick disconnect tool to the well, wherein the emergency quick disconnect tool is in mechanical communication with the emergency pipe stroker tool.

18. The method of claim 15, further comprising the step of orienting the emergency pipe stroker tool, the cement retainer, or combinations thereof, with respect to the well by using at least one funnel guide.

* * * * *